US011472001B2

(12) United States Patent
Cheng et al.

(10) Patent No.: US 11,472,001 B2
(45) Date of Patent: Oct. 18, 2022

(54) ELASTIC MEMBRANE AND SUBSTRATE HOLDING APPARATUS

(71) Applicant: EBARA CORPORATION, Tokyo (JP)

(72) Inventors: Cheng Cheng, Tokyo (JP); Shingo Togashi, Tokyo (JP); Makoto Fukushima, Tokyo (JP); Kazuto Hirokawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/004,327

(22) Filed: Aug. 27, 2020

(65) Prior Publication Data

US 2021/0060725 A1 Mar. 4, 2021

(30) Foreign Application Priority Data

Aug. 29, 2019 (JP) ..... JP2019-156987
Aug. 29, 2019 (JP) ..... JP2019-156988

(51) Int. Cl.
*B24B 37/30* (2012.01)

(52) U.S. Cl.
CPC ..... *B24B 37/30* (2013.01)

(58) Field of Classification Search
CPC ..... B24B 37/30; B24B 37/32; B24B 37/34
USPC ..... 451/283, 285, 287, 288, 364, 398, 385, 451/388, 387
See application file for complete search history.

(56) References Cited

U.S. PATENT DOCUMENTS 5,851,140 A * 12/1998 Barns ..... B24B 37/30 451/288
6,080,050 A * 6/2000 Chen ..... B24B 37/30 451/388
6,132,298 A * 10/2000 Zuniga ..... B24B 37/30 451/41
6,159,079 A * 12/2000 Zuniga ..... B24B 37/30 451/286
6,162,116 A * 12/2000 Zuniga ..... B24B 37/32 451/288
6,210,255 B1 * 4/2001 Zuniga ..... B24B 37/30 451/41
6,227,955 B1 * 5/2001 Custer ..... B24B 37/32 438/692

(Continued)

FOREIGN PATENT DOCUMENTS

JP 2006-159392 A 6/2006

*Primary Examiner* — Joseph J Hail
*Assistant Examiner* — Jonathan R Zaworski
(74) *Attorney, Agent, or Firm* — BakerHostetler

(57) ABSTRACT

An elastic membrane capable of being easily secured to a head body of a substrate holding apparatus while inhibiting variation of a degree of deformation of the elastic membrane in a circumferential direction is disclosed. The elastic membrane according to the present invention is used in the substrate holding apparatus. The elastic membrane includes: a contact portion to be brought into contact with a substrate for pressing the substrate against a polishing pad; and an edge circumferential wall extending from a peripheral edge of the contact portion. The edge circumferential wall includes an edge-circumferential-wall lip portion sandwiched between a head body of the substrate holding apparatus and an edge mounting member for securing the edge circumferential wall to the head body. The edge-circumferential-wall lip portion has at least a part of a surface thereof roughened.

9 Claims, 16 Drawing Sheets

(56) References Cited

U.S. PATENT DOCUMENTS 6,241,593 B1 * 6/2001 Chen ..... B24B 37/30 451/288
6,361,419 B1 * 3/2002 Zuniga ..... B24B 37/30 451/287
6,406,361 B1 * 6/2002 Zuniga ..... B24B 37/30 451/286
6,422,927 B1 * 7/2002 Zuniga ..... B24B 37/32 451/388
6,450,868 B1 * 9/2002 Zuniga ..... B24B 37/30 451/388
6,705,932 B1 * 3/2004 Zuniga ..... B24B 37/30 451/285
6,712,673 B2 * 3/2004 Albrecht ..... B24B 37/30 451/63
6,890,249 B1 * 5/2005 Zuniga ..... B24B 37/32 451/399
7,101,271 B2 * 9/2006 Moon ..... B24B 37/30 451/288
7,166,019 B2 * 1/2007 Park ..... B24B 37/30 279/3
7,635,292 B2 * 12/2009 Togawa ..... B24B 37/30 451/288
7,654,888 B2 * 2/2010 Zuniga ..... B24B 37/30 451/288
7,727,055 B2 * 6/2010 Zuniga ..... B24B 37/30 451/288
7,959,496 B2 * 6/2011 Spiegel ..... B24B 37/30 451/442
8,454,413 B2 * 6/2013 Oh ..... B29C 35/02 451/398
8,475,231 B2 * 7/2013 Paik ..... B24B 37/30 451/41
8,808,062 B2 8/2014 Oh et al.
8,859,070 B2 * 10/2014 Yasuda ..... B32B 3/18 428/64.1
8,939,817 B2 * 1/2015 Son ..... B24B 41/061 451/288
9,381,613 B2 * 7/2016 Leighton ..... B24B 41/061
9,452,505 B2 9/2016 Oh et al.
9,573,244 B2 * 2/2017 Fukushima ..... B24B 37/30
10,160,093 B2 * 12/2018 Paik ..... B24B 37/30
2006/0154580 A1 * 7/2006 Chen ..... B24B 37/30 451/288
2009/0242125 A1 * 10/2009 Paik ..... B24B 37/30 51/299
2013/0316628 A1 * 11/2013 Jang ..... B24B 37/30 451/398
2018/0117730 A1 * 5/2018 Nabeya ..... B24B 37/32

* cited by examiner

ELASTIC MEMBRANE AND SUBSTRATE HOLDING APPARATUS

CROSS REFERENCE TO RELATED APPLICATION

This document claims priorities to Japanese Patent Application Number 2019-156987 filed Aug. 29, 2019 and Japanese Patent Application Number 2019-156988 filed Aug. 29, 2019, the entire contents of which are hereby incorporated by reference.

BACKGROUND

A polishing apparatus for performing CMP has a polishing table that supports the polishing pad thereon, and a substrate holding apparatus for holding a substrate, such as wafer. The substrate holding apparatus may be called a top ring or a polishing head. When the substrate is polished using such polishing apparatus, the substrate holding apparatus holds the substrate and presses it against the polishing surface of the polishing pad at a predetermined pressure, while the polishing table and the substrate holding apparatus are moved relative to each other to bring the substrate into sliding contact with the polishing surface to thereby polish a surface of the substrate.

During polishing of the substrate, if a relative pressing force applied between the wafer and the polishing surface of the polishing pad is not uniform over the entire surface of the wafer, insufficient polishing or excessive polishing would occur depending on a force applied to each portion of the wafer. Thus, in order to make the pressing force against the wafer uniform, the substrate holding apparatus has a pressure chamber defined by an elastic membrane at a lower part thereof. This pressure chamber is supplied with a fluid, such as air, to press the wafer through the elastic membrane with a fluid pressure.

Such a substrate holding apparatus has, for example, a head body for pressing the substrate against the polishing surface of the polishing pad, said elastic membrane secured to the head body, a mounting member for securing the elastic membrane to the head body, and a retaining ring surrounding a substrate held by the head body through the elastic membrane. When the elastic membrane is secured by the mounting members, at least one pressure chamber is formed by the elastic membrane. Such an elastic membrane is consumable, and thus regularly requires maintenance and/or replacement thereof. Therefore, the elastic membrane is configured to be detachable to the head body by use of the mounting members.

However, the elastic membrane is typically made of materials, such as rubber, which are not only flexible but also highly adhesive. Therefore, when a worker secures the elastic membrane to the head body through the mounting members, a portion of the elastic membrane may be in close contact with the head body and/or the mounting member, making it difficult to properly secure the elastic membrane to the head body. More specifically, if a portion (or a plurality of portions) of the elastic membrane is in close contact with the head body and/or the mounting members, the close-contacted portion(s) may cause other portions of the elastic membrane to be pulled, resulting in varying a degree of deformation of the elastic membrane in a circumferential direction. In other words, the elastic membrane secured to the head body may be distorted unevenly in the circumferential direction thereof.

When polishing of the substrate is performed, fluid having a predetermined pressure is supplied into the pressure chamber formed by the elastic membrane. Thus, if the degree of deformation of the elastic membrane in the circumferential direction varies, the elastic membrane may not be evenly inflated, result in lowering a uniformity of polishing rate in a circumferential direction of the substrate.

If, in order to prevent the above-mentioned problems, a worker to secure the elastic membrane to the head body tries to eliminate variation in the degree of deformation of the elastic membrane in the circumferential direction, burden and labor of the worker increases and it takes a long time to secure the elastic membrane to the head body.

SUMMARY OF THE INVENTION

Therefore, there is provided an elastic membrane capable of being easily secured to a head body of a substrate holding apparatus while inhibiting variation of a degree of deformation of the elastic membrane in a circumferential direction. Further, there is provided a substrate holding apparatus including such elastic membrane.

Embodiments, which will be described below, relate to an elastic membrane for use in a substrate holding apparatus of a polishing apparatus. Further, Embodiments, which will be described below, relate to a substrate holding apparatus having such an elastic membrane.

In an embodiment, there is provided an elastic membrane for use in a substrate holding apparatus, comprising: a contact portion to be brought into contact with a substrate for pressing the substrate against a polishing pad; and an edge circumferential wall extending from a peripheral edge of the contact portion, wherein the edge circumferential wall includes an edge-circumferential-wall lip portion sandwiched between a head body of the substrate holding apparatus and an edge mounting member for securing the edge circumferential wall to the head body, and the edge-circumferential-wall lip portion has at least a part of a surface thereof roughened.

In an embodiment, the edge circumferential wall has an edge-circumferential-wall body which extends from the contact portion and is connected to the edge-circumferential-wall lip portion, and a contact surface of the edge-circumferential-wall body with the edge mounting member also is roughened.

In an embodiment, the elastic membrane further comprises at least one inner circumferential wall which is located radially inwardly of the edge circumferential wall and extends from the contact portion, wherein the inner circumferential wall has an inner-circumferential-wall lip portion sandwiched between the head body and an inner mounting member for securing the inner circumferential wall to the head body, and the inner-circumferential-wall has at least a part of a surface thereof roughened.

In an embodiment, the inner circumferential wall has an inner-circumferential-wall body which extends from the contact portion and is connected to the inner-circumferential-wall lip portion, and a contact surface of the inner-circumferential-wall body with the inner mounting member also is roughened.

In an embodiment, an entire surface of the elastic membrane is roughened.

In an embodiment, there is provided a substrate holding apparatus, comprising: an elastic membrane that forms at least one pressure chamber for pressing a substrate; a head body to which the elastic membrane is secured; and at least one mounting member for securing the elastic membrane to the head body, wherein the elastic membrane includes: a contact portion to be brought into contact with the substrate for pressing the substrate against a polishing pad; and an edge circumferential wall extending from a peripheral edge of the contact portion, the edge circumferential wall includes an edge-circumferential-wall lip portion sandwiched between the head body and an edge mounting member which is one of at least one mounting member, and the edge-circumferential-wall lip portion has at least a part of a surface thereof roughened.

In an embodiment, a surface of the edge mounting member is covered with a friction-reducing film.

In an embodiment, there is provided a substrate holding apparatus, comprising: an elastic membrane that forms at least one pressure chamber for pressing a substrate; a head body to which the elastic membrane is secured; and at least one mounting member for securing the elastic membrane to the head body, wherein the elastic membrane includes: a contact portion to be brought into contact with the substrate for pressing the substrate against a polishing pad; and an edge circumferential wall extending from a peripheral edge of the contact portion, the edge circumferential wall includes an edge-circumferential-wall lip portion sandwiched between the head body and an edge mounting member which is one of at least one mounting member, and a surface of the edge mounting member and/or a surface of the head body facing to the edge-circumferential-wall lip portion is roughened.

In an embodiment, there is provided an elastic membrane for use in a substrate holding apparatus, comprising: a contact portion to be brought into contact with a substrate for pressing the substrate against a polishing pad; and an edge circumferential wall extending from a peripheral edge of the contact portion, wherein the edge circumferential wall has an edge-circumferential-wall lip portion formed in an upper portion thereof, which is sandwiched between a head body of the substrate holding apparatus and an edge mounting member for securing the edge circumferential wall to the head body; the edge-circumferential-wall lip portion includes a plurality of edge-circumferential-wall projections which are fitted into first recesses formed in the edge mounting member and/or second recesses formed in the head body; and the edge-circumferential-wall projections are arranged at equal intervals along a circumferential direction of the edge circumferential wall.

In an embodiment, the edge-circumferential-wall projections are vertical edge projections that protrude from an upper surface or a lower surface of the edge-circumferential-wall lip portion.

In an embodiment, the edge-circumferential-wall projections are lateral edge projections that protrude from a tip of the edge-circumferential-wall lip portion in a radial direction of the edge circumferential wall.

In an embodiment, some of the edge-circumferential-wall projections are vertical edge projections that protrude from an upper surface or a lower surface of the edge-circumferential-wall lip portion, and the rest of the edge-circumferential-wall projections are lateral edge projections that protrude from a tip of the edge-circumferential-wall lip portion in a radial direction of the edge circumferential wall.

In an embodiment, the elastic membrane further comprises at least one inner circumferential wall which is located radially inwardly of the edge circumferential wall and extends from the contact portion, wherein the inner circumferential wall has an inner-circumferential-wall lip portion formed at an upper portion thereof, which is sandwiched between the head body and an inner mounting member for securing the inner circumferential wall to the head body, the inner-circumferential-wall lip portion has a plurality of inner-circumferential-wall projections which are fitted into third recesses formed in the edge mounting member and/or forth recesses formed in the head body, and the inner-circumferential-wall projections are arranged at equal intervals along a circumferential direction of the inner circumferential wall.

In an embodiment, the inner-circumferential-wall projections are vertical inner projections that protrude from an upper surface or a lower surface of the inner-circumferential-wall lip portion.

In an embodiment, the inner-circumferential-wall projections are lateral inner projections that protrude from a tip of the inner-circumferential-wall lip portion in a radial direction of the inner circumferential wall.

In an embodiment, some of the inner-circumferential-wall projections are vertical inner projections that protrude from an upper surface or a lower surface of the inner-circumferential-wall lip portion, and the rest of the inner-circumferential-wall projections are lateral inner projections that protrude from a tip of the inner-circumferential-wall lip portion in a radial direction of the inner circumferential wall.

In an embodiment, there is provided a substrate holding apparatus, comprising: an elastic membrane that forms at least one pressure chamber for pressing a substrate; a head body to which the elastic membrane is secured; and at least one mounting member for securing the elastic membrane to the head body, wherein the elastic membrane comprises the above-described elastic membrane.

According to the present invention, as compared with the case where the surface of the edge-circumferential-wall lip portion is not roughened, a contact area of the edge-circumferential-wall lip portion with the edge mounting member and/or a contact area of the edge-circumferential-wall lip portion with the head body are reduced. As a result, the elastic membrane is inhibited from being in close contact with the edge mounting member and/or the head body. Accordingly, the elastic membrane can be smoothly and easily moved with respect to the edge mounting member and/or the head body, so that the elastic membrane can be easily secured to the head body while inhibiting the variation in the degree of deformation of the elastic membrane in the circumferential direction.

Further, according to the present invention, the elastic membrane is secured to the head body in a state where the plurality of edge-circumferential-wall projections arranged at equal intervals along the circumferential direction of the edge circumferential wall are fitted into the first recesses and/or the second recesses. Therefore, the elastic membrane can be secured to the head body while inhibiting the deformation of the elastic membrane in the circumferential direction to the minimum. Further, when the elastic membrane is secured to the head body through the mounting member, the plurality of edge-circumferential-wall projections serves as guides with respect to the head body and/or the edge mounting member. Accordingly, the elastic membrane can be easily secured to the head body.

DESCRIPTION OF EMBODIMENTS

Embodiments will be described below with reference to the drawings.

Figure 1:
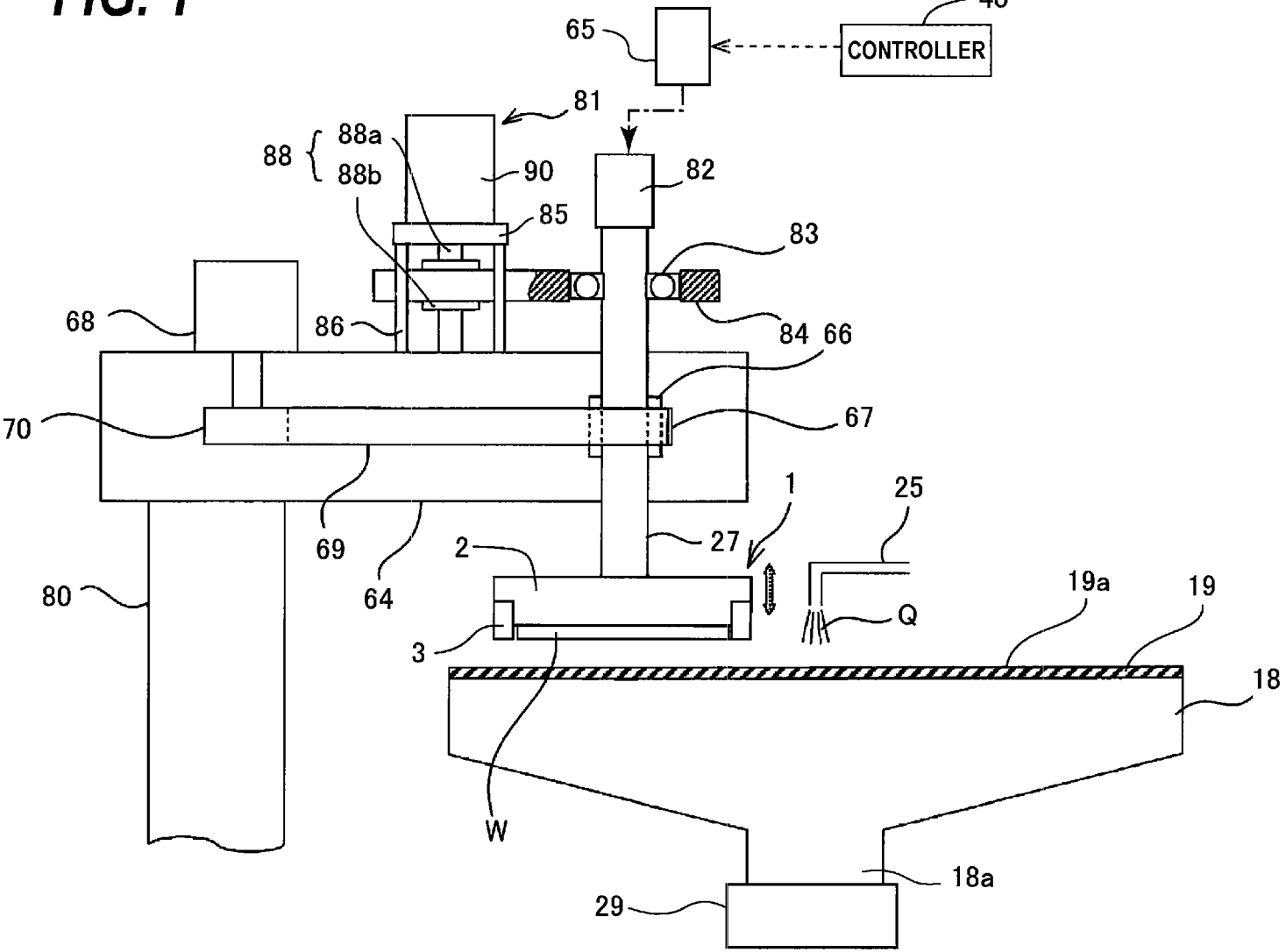
FIG. 1 is a view showing a polishing apparatus according to an embodiment.

FIG. 1 is a view showing a polishing apparatus according to an embodiment. As shown in FIG. 1, the polishing apparatus includes a polishing table 18 for supporting a polishing pad 19, and a substrate holding apparatus 1 for holding a wafer W as an example of a substrate and pressing the wafer W against the polishing pad 19 on the polishing table 18. In the following description, the substrate holding apparatus 1 will be referred to as a "polishing head 1".

The polishing table 18 is coupled via a table shaft 18*a* to a table motor 29 disposed below the polishing table 18, so that the polishing table 18 is rotatable about the table shaft 18*a*. The polishing pad 19 is attached to an upper surface of the polishing table 18. A surface 19*a* of the polishing pad 19 serves as a polishing surface for polishing the wafer W. A polishing liquid supply nozzle 25 is provided above the polishing table 18 so that the polishing liquid supply nozzle 25 supplies a polishing liquid Q onto the polishing pad 19 on the polishing table 18.

The polishing head 1 includes a head body 2 for pressing the wafer W against the polishing surface 19*a*, and a retaining ring 3 for retaining the wafer W therein so as to prevent the wafer W from slipping out of the polishing head 1. The polishing head 1 is coupled to a head shaft 27, which is vertically movable relative to a head arm 64 by a vertically moving mechanism 81. This vertical movement of the head shaft 27 causes the entirety of the polishing head 1 to move upward and downward relative to the head arm 64 and enables positioning of the polishing head 1. A rotary joint 82 is mounted to an upper end of the head shaft 27.

The vertically moving mechanism 81 for elevating and lowering the head shaft 27 and the polishing head 1 includes a bridge 84 that rotatably supports the head shaft 27 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the head arm 64 through the support posts 86.

The ball screw 88 includes a screw shaft 88*a* coupled to the servomotor 90 and a nut 88*b* that engages with the screw shaft 88*a*. The head shaft 27 is vertically movable together with the bridge 84. When the servomotor 90 is set in motion, the bridge 84 moves vertically through the ball screw 88, so that the head shaft 27 and the polishing head 1 move vertically.

The head shaft 27 is coupled to a rotary sleeve 66 by a key (not shown). A timing pulley 67 is secured to a circumferential surface of the rotary sleeve 66. A head motor 68 is fixed to the head arm 64. The timing pulley 67 is coupled through a timing belt 69 to a timing pulley 70, which is mounted to the head motor 68. When the head motor 68 is set in motion, the rotary sleeve 66 and the head shaft 27 are rotated together with the timing pulley 70, the timing belt 69, and the timing pulley 67, thus rotating the polishing head 1. The head arm 64 is supported by an arm shaft 80, which is rotatably supported by a frame (not shown). The polishing apparatus includes a controller 40 for controlling devices including the head motor 68 and the servomotor 90.

The polishing head 1 is configured to be able to hold the wafer W on its lower surface. The head arm 64 is configured to be able to pivot on the arm shaft 80. Thus, the polishing head 1, when holding the wafer W on its lower surface, is moved from a position at which the polishing head 1 receives the wafer W to a position above the polishing table 18 by a pivotal movement of the head arm 64.

Polishing of the wafer W is performed as follows. The polishing head 1 and the polishing table 18 are rotated individually, while the polishing liquid Q is supplied from the polishing liquid supply nozzle 25, located above the polishing table 18, onto the polishing pad 19. In this state, the polishing head 1 is lowered to a predetermined position (i.e., a predetermined height) and then presses the wafer W against the polishing surface 19*a* of the polishing pad 19. The wafer W is placed in sliding contact with the polishing surface 19*a* of the polishing pad 19, so that a surface of the wafer W is polished.

Figure 2:
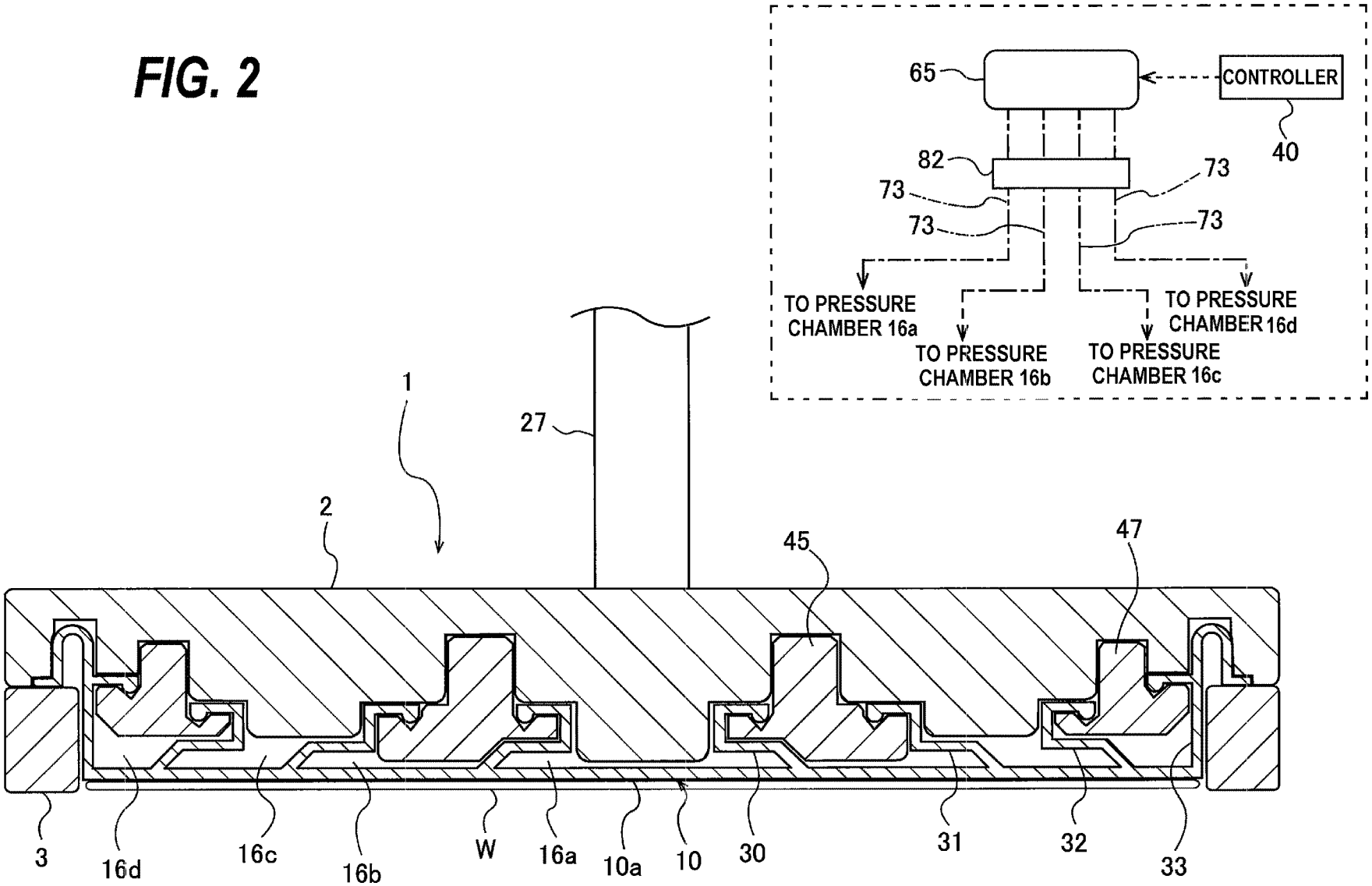
FIG. 2 is a schematic cross-sectional view showing a polishing head according to an embodiment.

Next, an example of the configuration of the polishing head 1 will be described with reference to FIG. 2. FIG. 2 is a schematic cross-sectional view showing the polishing head (substrate holding apparatus) 1 according to an embodiment. As shown in FIG. 2, the polishing head 1 includes the head body 2 for pressing the wafer W against the polishing surface 19*a* (see FIG. 1), and the retaining ring 3 arranged so as to surround the wafer W. The retaining ring 3 is coupled to the head body 2, and the head body 2 and the retaining ring 3 are rotatable in unison by the rotation of the head shaft 27. Further, the head body 2 and the retaining ring 3 are configured to move up and down in unison with the head shaft 27 by actuating the vertical movement mechanism 81 (see FIG. 1). The head body 2 is, for example, made of resin, such as engineering plastic (e.g., PEEK), The retaining ring 3 is arranged so as to surround the elastic membrane 10 secured to the head body 2, and the wafer W held by the head body 2 through the elastic membrane 10. This retaining ring 3 retains the wafer W therein so as to prevent the wafer W from slipping out of the polishing head 1 during polishing of the wafer W.

The elastic membrane 10, which is brought into contact with a back surface of the wafer W (i.e., a surface at an opposite side of the surface to be polished), is secured to a lower surface of the head body 2. This elastic membrane 10 has a lower surface which serves as a substrate holding surface 10*a*. The elastic membrane 10 has a plurality of annular circumferential walls 30, 31, 32, and 33 (four circumferential walls in FIG. 2), and these circumferential walls 30 to 33 are concentrically arranged.

In this embodiment, the polishing head 1 has two mounting members 45, 47 for securing the elastic membrane 10 to the head body 2. The two mounting members 45, 47 are mounting rings having a substantially annular shape, respectively. In the following description, the mounting member 45 may be referred to as a "first mounting ring 45", and the mounting member 47 may be referred to as a "second mounting ring 47".

Upper ends of the circumferential walls 30 to 33 are secured to the lower surface of the head body 2 through the two mounting rings 45, 47. More specifically, the first mounting ring 45 secures the upper ends of the circumferential walls 30 and 31 to the lower surface of the head body 2, and the second mounting ring 47 secures the upper ends of the circumferential walls 32 and 33 to the lower surface of the head body 2. These mounting rings 45 and 47 are detachably secured to the head body 2 by fasteners (not shown), such as screws, respectively. Therefore, when the fasteners are released, the mounting rings 45 and 47 are separated from the head body 2, whereby the elastic membrane 10 can be removed from the head body 2.

The circumferential walls 30 to 33 define four pressure chambers: a circular central pressure chamber 16*a* located at a center of the elastic membrane 10, an annular edge pressure chamber 16*d* located at the outermost part of the elastic membrane 10, and intermediate pressure chambers 16*b*, and 16*c* located between the central pressure chamber 16*a* and the edge pressure chamber 16*f*.

These pressure chambers 16*a* to 16*d* are in fluid communication with a pressure regulator 65 via the rotary joint 82, so that a fluid (e.g., air) is supplied into the respective pressure chambers 16*a* to 16*d* through respective fluid lines 73 extending to the respective pressure chambers 16*a* to 16*d* from the pressure regulator 65. The pressure regulator 65 is connected to a controller 40, so that pressures in the four pressure chambers 16*a* to 16*d* can be independently adjusted.

Further, the pressure regulator 65 can create a negative pressure in the pressure chambers 16*a* to 16*d*. Thus, in the polishing head 1, pressing forces applied to the wafer W can be adjusted at respective zones of the wafer W by adjusting pressures of the fluid supplied to the respective pressure chambers 16*a* to 16*d* formed between the head body 2 and the elastic membrane 10.

The elastic membrane 10 is made of a highly strong and durable rubber material, such as ethylene propylene rubber (EPDM), polyurethane rubber, silicone rubber, or the like. Such elastic membrane 10 has not only flexibility but also high adhesiveness. The respective pressure chambers 16*a* to 16*d* are further coupled to a pressure relief mechanism (not shown), which can establish a fluid communication between the atmosphere and these pressure chambers 16*a* to 16*d*.

Figure 3:
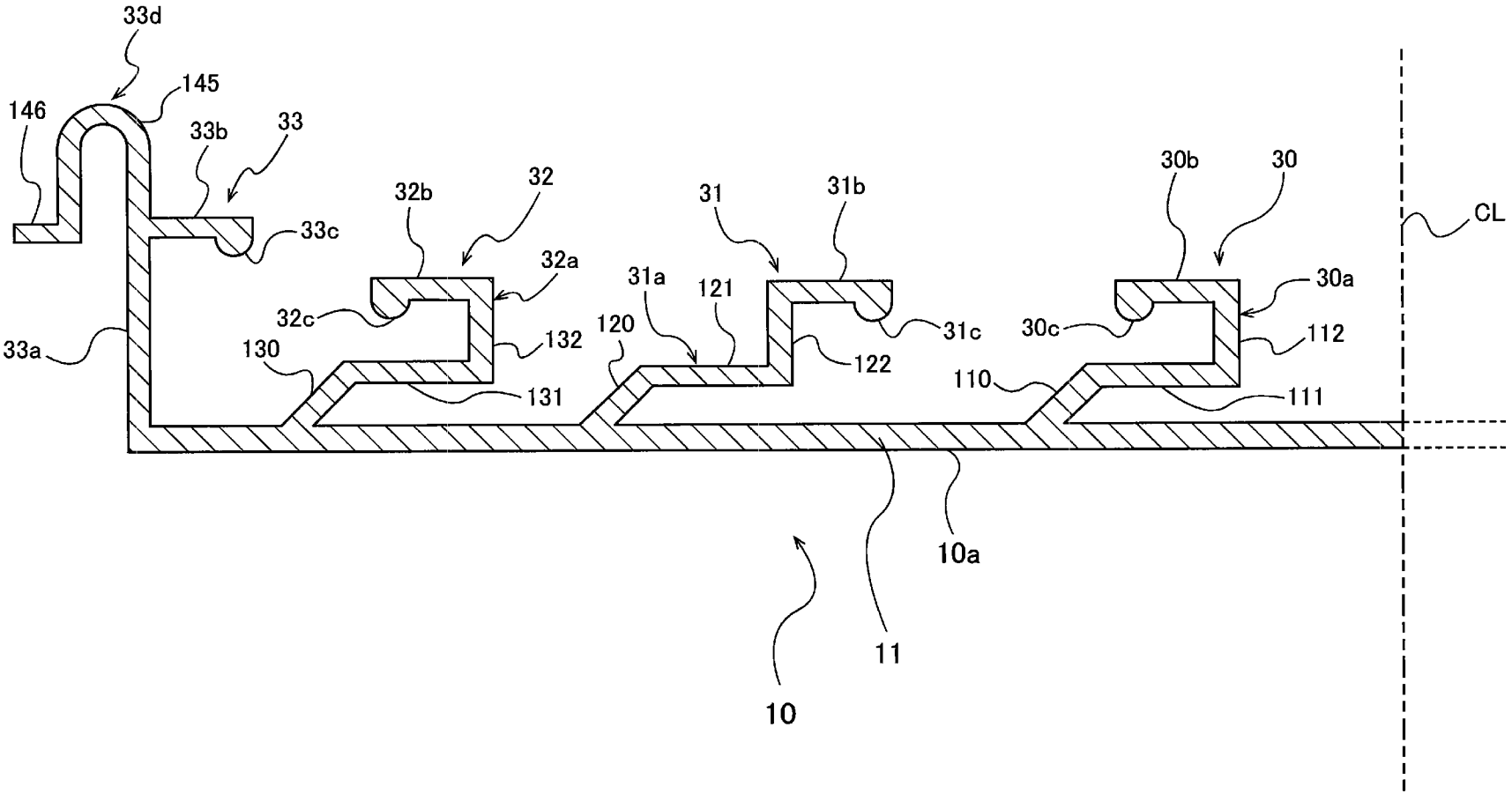
FIG. 3 is an enlarged cross-sectional view showing a part of the elastic membrane shown in FIG. 2.
Figure 4:
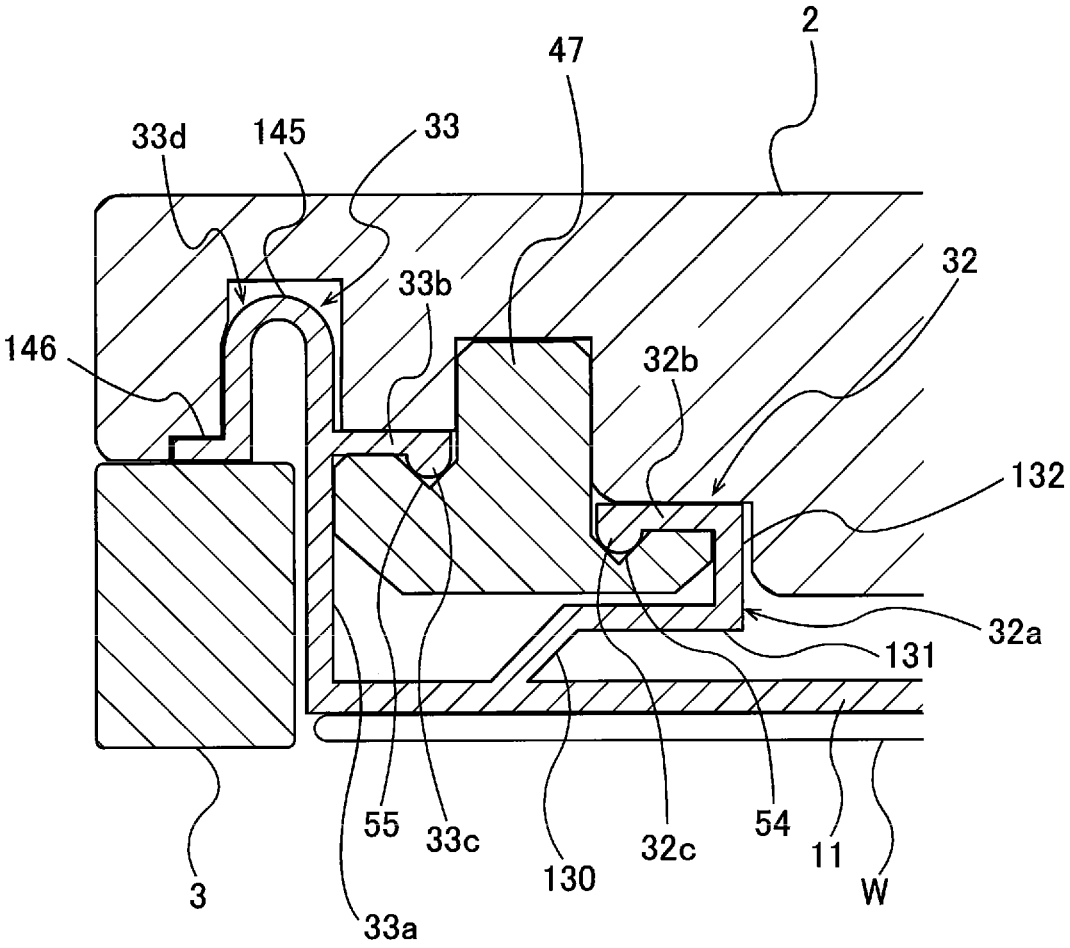
FIG. 4 is an enlarged cross-sectional view showing the vicinity of the second mounting ring shown in FIG. 2.

Next, the elastic membrane 10 shown in FIG. 2 will be described in more detail. FIG. 3 is an enlarged cross-sectional view showing a part of the elastic membrane shown in FIG. 2. More specifically, FIG. 3 illustrates a schematic cross-section of a half of the elastic membrane 10 divided by a vertical plane containing a central axis CL of the elastic membrane 10. FIG. 4 is an enlarged cross-sectional view showing the vicinity of the second mounting ring 47 shown in FIG. 2 (i.e., the vicinity of an edge circumferential wall described later).

The elastic membrane 10 shown in FIG. 3 has a circular contact portion 11 which can be brought into contact with the back surface of the wafer W, and the four circumferential walls 30 to 33 which are coupled to the contact portion 11. The contact portion 11 is brought into contact with the back surface of the wafer W to press the wafer W against the polishing pad 19. Specifically, a lower surface of the contact portion 11 serves as the above-mentioned substrate holding surface 10*a*. The annular circumferential walls 30 to 33 extend upwardly from an upper surface of the contact portion 11.

The circumferential wall 33 is an outermost circumferential wall and extends upwardly from a peripheral edge of the contact portion 11. In this specification, the circumferential wall 33 is referred to as an "edge circumferential wall 33". Further, in this specification, each of the circumferential walls which are arranged radially inwardly of the edge circumferential wall 33, is referred to as "inner circumferential wall". In the embodiment shown in FIG. 3, the three circumferential walls 30, 31 and 32 are configured as the inner circumferential walls, respectively. In the following description, the circumferential wall 30 may be referred to as a "first inner circumferential wall 30", the circumferential wall 31 may be referred to as a "second inner circumferential wall 31", and the circumferential wall 32 may be referred to as a "third inner circumferential wall 33". The number of inner circumferential walls is not limited to the illustrated example. For example, the elastic membrane 10 may have the edge circumferential wall 33 and one inner circumferential wall, or may have the edge circumferential wall 33 and two or more inner circumferential walls. Further, the elastic membrane 10 may have only edge circumferential wall 33 without having inner circumferential wall.

The edge circumferential wall 33 has an edge-circumferential-wall body 33*a* extending from the contact portion 11, and an edge-circumferential-wall lip portion 33*b* coupled to the edge-circumferential-wall body 33*a*. In the embodiment shown in FIG. 3, the edge-circumferential-wall body 33*a* extends from the contact portion 11 upwardly in a vertical direction, and the edge-circumferential-wall lip portion 33*b* extends from a tip of the edge-circumferential-wall body 33*a* in a horizontal direction. The edge-circumferential-wall body 33*a* extends in an annular manner around the central axis CL (i.e., over the entire circumference of the contacting portion 11), and the edge-circumferential-wall lip portion 33*b* extends in a flange shape over the entire circumference of the edge-circumferential-wall body 33*a*. The edge-circumferential-wall lip portion 33*b* has a seal projection 33*c* formed in a lower surface thereof. The seal projection 33*c* is formed in the lower surface of the tip portion of the edge-circumferential-wall lip portion 33*b*, and extends in an annular manner over the entire circumference of the edge-circumferential-wall lip portion 33*b*.

Further, the edge circumferential wall 33 may have a flap 33*d* extending from a point of connection between the edge-circumferential-wall body 33*a* and the edge-circumferential-wall lip portion 33*b*. The flap 33*d* extends over the entire circumference of the edge circumferential wall 33. The flap 33*d* includes a flap body 145 having an inverted U-shaped cross section, and a flap lip portion 146 extending horizontally from a tip of the flap body 145. The flap lip portion 146 is sandwiched between the head body 2 and the retaining ring 3 (see FIG. 4).

As shown in FIG. 4, the edge-circumferential-wall lip portion 33*b* is a part of the edge circumferential wall 33 which is sandwiched between the second mounting ring 47 and the head body 2. Therefore, the edge-circumferential-wall lip portion 33*b* is formed in a top portion of the edge circumferential wall 33 excluding the flap 33*d*. In other words, the edge-circumferential-wall lip portion 33*b* is connected to an upper end of the edge-circumferential-wall body 33*a*. When, in a state where the edge-circumferential-wall lip portion 33*b* is sandwiched between the head body 2 and the second mounting ring 47, the second mounting member 47 is secured to the head body 2 by fasteners (not shown), such as screws, the edge circumferential wall 33 is secured to the head body 2. Accordingly, the second mounting ring 47 serves as an edge mounting member for securing the edge circumferential wall 33 to the head body 10.

The second mounting ring 47 is formed with a seal recess 55 into which the seal projection 33*c* is fitted. The seal recess 55 is formed over the entire circumference of the second mounting ring 47, corresponding to the seal projection 33*c*. When the edge circumferential wall 33 is secured to the head body 2, the seal projection 33*c* is fitted into the seal recess 55. In this state, when the second mounting member 47 is secured to the head body 2 using fasteners (not shown), the seal projection 33*c* is pressed against the seal recess 55 to thereby seal a gap between the second mounting ring 47 and the edge-circumferential-wall lip portion 33*b*.

The third inner circumferential wall 32 also has a third inner-circumferential-wall body 32*a* extending from the contact portion 11, and a third inner-circumferential-wall lip portion 32*b* connected to the third inner-circumferential-wall body 32*a*. The third inner-circumferential-wall body 32*a* also extends in an annular manner around the central axis CL, and the third inner-circumferential-wall lip portion 32*b* extends in a flange shape over the entire circumference of the third inner-circumferential-wall body 32*a*. The third inner-circumferential-wall body 32*a* is constructed of an inclined portion 130 extending diagonally upward and inwardly in a radial direction from the contact portion 11, a horizontal portion 131 connected to the inclined portion 130 and extending inwardly in the radial direction, and a vertical portion 132 connected to the horizontal portion 131 and extending from the horizontal portion 131 vertically. The third inner-circumferential-wall lip portion 32*b* is connected to a tip of the vertical portion 132 of the third inner-circumferential-wall body 32*a*, and extends horizontally outwardly in a radial direction from this tip. The third inner circumferential wall 32 also has a seal projection 32*c* formed in an annular manner over the entire circumference of the third inner-circumferential-wall lip portion 32*b*.

The third inner-circumferential-wall lip portion 32*b* is a part of the third inner circumferential wall 32 which is sandwiched between the second mounting ring 47 and the head body 2, and formed in a top portion of the third inner circumferential wall 32. In other words, the third inner-circumferential-wall lip portion 32*b* is connected to a tip of the third inner-circumferential-wall body 32*a*. The second mounting ring 47 serves as the edge mounting member with respect to the above-described edge circumferential wall 33, and serves as an inner mounting member with respect to the third inner circumferential wall 32 for securing the third inner circumferential wall 32 to the head body 2. Therefore, the second mounting member 47 also has a seal recess 54 formed in correspondence with the seal projection 32*c* of the third edge circumferential wall 32. The seal recess 54 is formed over the entire circumference of the second mounting member 47. When the second mounting member 47 is secured to the head body 2 by fasteners (not shown), the third inner-circumferential-wall lip portion 32*b* is sandwiched between the head body 2 and the second mounting ring 47, so that the third inner circumferential wall 32 is secured to the head body 2. Further, the seal projection 32*b* of the third inner circumferential wall 32 is pressed against the seal recess 54 to thereby seal a gap between the second mounting ring 47 and the third inner-circumferential-wall lip portion 32*b*.

As shown in FIG. 3, the first inner circumferential wall 30 has the same shape as the third inner circumferential wall 32, and the second inner circumferential wall 31 differs from the shape of the third inner circumferential wall 32 only in that a second inner-circumferential-wall lip portion 31*b* extends inwardly in the radial direction not outwardly in the radial direction. More specifically, the first inner circumferential wall 30 has a first inner-circumferential-wall body 30*a* extending from the contact portion 11 upwardly, and a first inner-circumferential-wall lip portion 30*b* connected to the first inner-circumferential-wall body 30*a*, and the second inner circumferential wall 31 has a second inner-circumferential-wall body 31*a* extending from the contact portion 11 upwardly, and a second inner-circumferential-wall lip portion 31*b* connected to the second inner-circumferential-wall body 31*a*. The first inner-circumferential-wall body 30*a* and the second inner-circumferential-wall body 31*a* extend in an annular manner around the central axis CL, respectively. The first inner-circumferential-wall lip portion 30*b* is formed in a flange shape over the entire first inner-circumferential-wall body 30*a*, and the second inner-circumferential-wall lip portion 31*b* is formed in a flange shape over the second inner-circumferential-wall body 31*a*.

The first inner-circumferential-wall body 30*a* is constructed of an inclined portion 110 extending diagonally upward and inwardly in a radial direction from the contact portion 11, a horizontal portion 111 connected to the inclined portion 110 and extending inwardly in the radial direction, and a vertical portion 112 connected to the horizontal portion 111 and extending from the horizontal portion 111 vertically. The second inner-circumferential-wall body 31*a* is constructed of an inclined portion 120 extending diagonally upward and inwardly in a radial direction from the contact portion 11, a horizontal portion 121 connected to the inclined portion 120 and extending inwardly in the radial direction, and a vertical portion 122 connected to the horizontal portion 121 and extending from the horizontal portion 121 vertically.

Further, the first inner circumferential wall 30 has a seal projection 30*c* formed in an annular manner over the entire circumference of the first inner-circumferential-wall lip portion 30*b*, and the second inner circumferential wall 31 has a seal projection 31*c* formed in an annular manner over the entire circumference of the second inner-circumferential-wall lip portion 31*b*.

The first mounting ring 45 serves as an inner mounting member for securing the first inner circumferential wall 30 and the second inner circumferential wall 31 to the head body 2 (see FIG. 2). The first mounting ring 45 also has two seal recesses into which the seal projection 30*c* of the first inner circumferential wall 30 and the seal projection 31*c* of the second inner circumferential wall 31 are fitted respectively. These seal recesses also are formed over the entire circumference of the first mounting ring 45. When the first mounting ring 45 is secured to the head body 2 using fasteners (not shown), the first inner-circumferential-wall lip portion 30*b* and the second inner-circumferential-wall lip portion 31*b* are sandwiched between the head body 2 and the first mounting ring 45, so that the first inner circumferential wall 30 and the second inner circumferential wall 31 are secured to the head body 2. Further, the seal projection 30*c* of the first inner circumferential wall 30 is pressed against one seal recess, and at the same time, the seal projection 31*c* of the second inner circumferential wall 31 is pressed against the other seal recess. Thus, a gap between the first mounting ring 45 and the first inner-circumferential-wall lip portion 30*b* is sealed, and at the same time, a gap between the first mounting ring 45 and the second inner-circumferential-wall lip portion 31*b* is sealed.

As described above, the elastic membrane has not only flexibility but also high adhesiveness. Therefore, when the elastic membrane 10 is to be secured to the head body 2 through the mounting rings, 45, 47, a portion (or a plurality of portions) of the circumferential walls 30 to 33 of the elastic membrane 10 may be in close contact with the head body 2 and/or the mounting rings 45, 47. In this case, the close-contacted portion(s) occurring in the elastic membrane 10 may cause other portions of the elastic membrane to be pulled, resulting in varying a degree of deformation of the elastic membrane in a circumferential direction. In particular, when the edge circumferential wall located at the outermost part of the elastic membrane 10 is in close contact with the head body 2 and/or the second mounting ring 47, the variation in the degree of deformation of the elastic membrane 10 in the circumferential direction becomes large.

Figure 5:
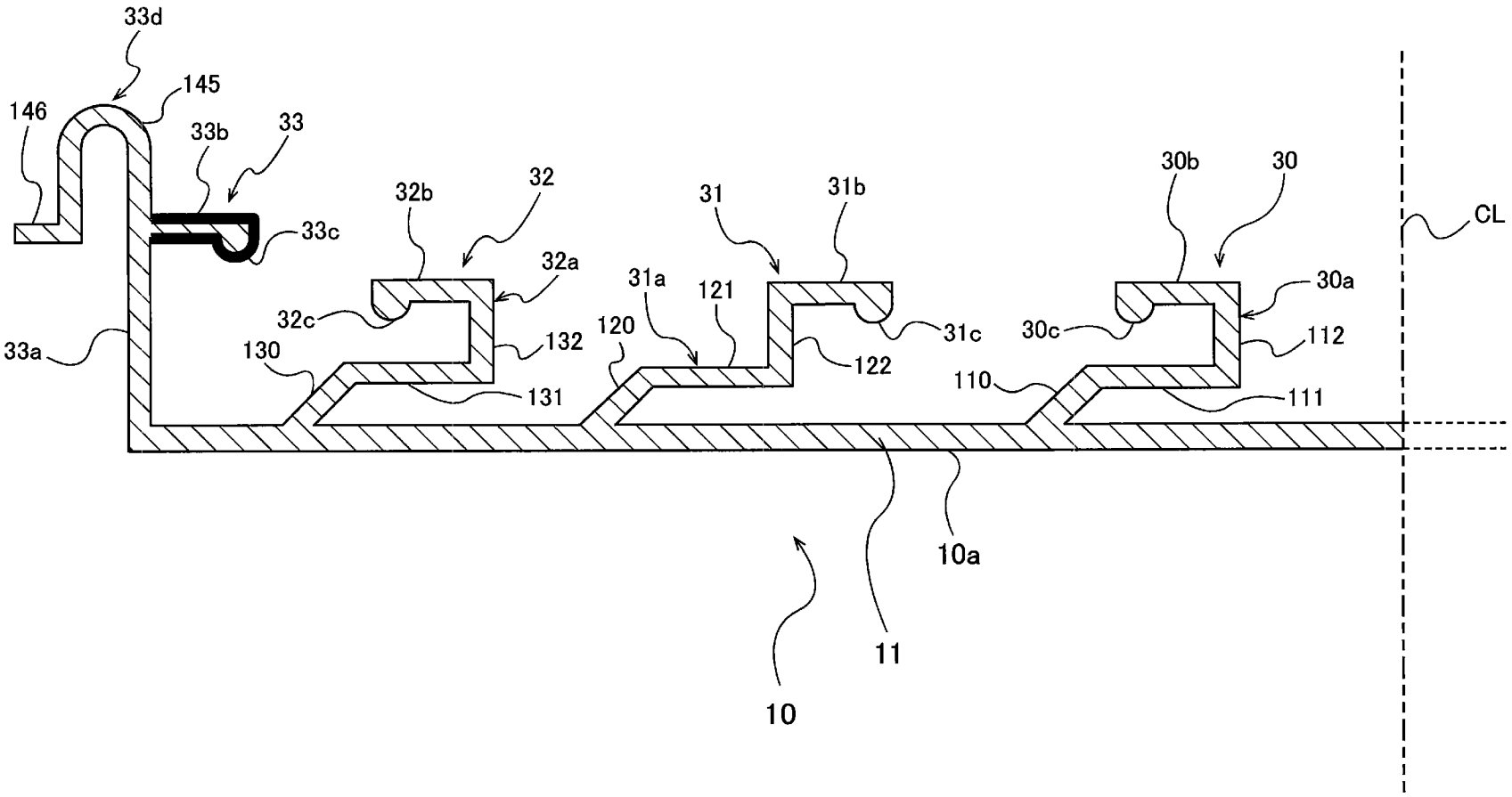
FIG. 5 is a view showing a roughened surface in the edge-circumferential-wall lip portion of the elastic membrane.

Therefore, in this embodiment, at least a portion of the surface of the edge-circumferential-wall lip portion 33*b* is roughened such that the edge-circumferential-wall lip portion 33*b* of the edge circumferential wall 33 can move smoothly with respect to the head body 2 and/or the second mounting ring 47. FIG. 5 is a view showing a roughened surface in the edge-circumferential-wall lip portion 33*b* of the elastic membrane 10. In FIG. 5, the roughened surface of the edge-circumferential-wall lip portion 33*b* is illustrated with a thick line.

As used herein, "roughening of the surface" means forming a plurality of protrusions and/or a plurality of recesses on the surface. The protrusions and/or the recesses may be regularly arranged on the surface, or may be irregularly (or randomly) arranged. The protrusions and the recesses have any shape. For example, the protrusions and the recesses may have a hemispherical shape, a conical shape, a pyramid shape, a cylindrical shape, a prismatic shape, or the like. Each protrusion and each recess have any height (i.e., a distance from the surface to the top of the protrusion), and any depth (i.e., a distance from the surface to the bottom of the recess), respectively. For example, the protrusion may be a fine protrusion having a height of about 10 μm, and the recess may be a fine recess having a depth of about 10 μm.

A method of roughening the surface of the elastic membrane 10 also is freely-selected. For example, various surface treatments, such as sandblasting, wet blasting, or roughing treatment using a tool such as a file, may be applied to the surface of the elastic membrane 10 to be roughened.

However, the elastic membrane 10 is typically formed by curing a rubber material poured into a molding die. Therefore, one of the afore-mentioned surface treatments, such as sandblasting, may be applied to an inner surface of the molding die corresponding to the surface of the elastic membrane 10 to be roughened. In this case, by simply removing the elastic membrane 10 from the molding die, it is possible to obtain the elastic membrane 10 in which the roughened surface is formed at a desired position. Accordingly, the elastic membrane with the roughened surface formed at the desired position can be easily and inexpensively manufactured. In one embodiment, the inner surface of the molding die corresponding to the surface of the elastic membrane 10 to be roughened may be subjected to so-called "texturing treatment".

In the embodiment shown in FIG. 5, the entire surface of the edge-circumferential-wall lip portion 33*b* is roughened. More specifically, the entire surface of the edge-circumferential-wall lip portion 33*b* including an upper surface, a lower surface, and a connecting surface connecting the upper surface with the lower surface is roughened. The edge-circumferential-wall lip portion 33*b* has the seal projection 33*c* in the lower surface thereof, and thus a surface of the seal projection 33*c* also is roughened.

In one embodiment, instead of roughening the entire surface of the edge-circumferential-wall lip portion 33*b*, at least a part of the surface of the edge-circumferential-wall lip portion 33*b* may be roughened. For example, only upper surface or lower surface of the edge-circumferential-wall lip portion 33*b* may be roughened. Alternatively, the upper surface and the lower surface of the edge-circumferential-wall lip portion 33*b* except the seal projection 33*c* may be roughened.

Roughening of the surface of the edge-circumferential-wall lip portion 33*b* enables a contact area of the edge-circumferential-wall lip portion 33*b* with the head body 2 and/or a contact area of the edge-circumferential-wall lip portion 33*b* with the second mounting member 47 to be reduced, as compared with a case where the surface of the edge-circumferential-wall lip portion 33*b* is flat without unevenness. As a result, even though the elastic membrane 10 has a high adhesiveness, the edge-circumferential-wall lip portion 33*b* is prevented from be in close contact with the head body 2 and/or the second mounting member 47. Therefore, the elastic membrane 10 can be smoothly and easily moved with respect to the head body 2 and/or the second mounting member 47, so that the elastic membrane 10 can be easily secured to the head body 2 while inhibiting the variation in the degree of deformation of the elastic membrane 10 in the circumferential direction.

Although, in the embodiment shown in FIG. 5, the surface of the edge-circumferential-wall lip portion 33*b* is roughened, the present invention is not limited to this embodiment. Hereinafter, embodiments of the elastic membrane 10, in which the surface of the edge-circumferential-wall lip portion 33*b* as well as surfaces of other parts are roughened, will be described. Structures of these embodiments, which will not be specifically described, are the same as those of the above-described embodiment, and duplicate explanations will be omitted.

Figure 6:
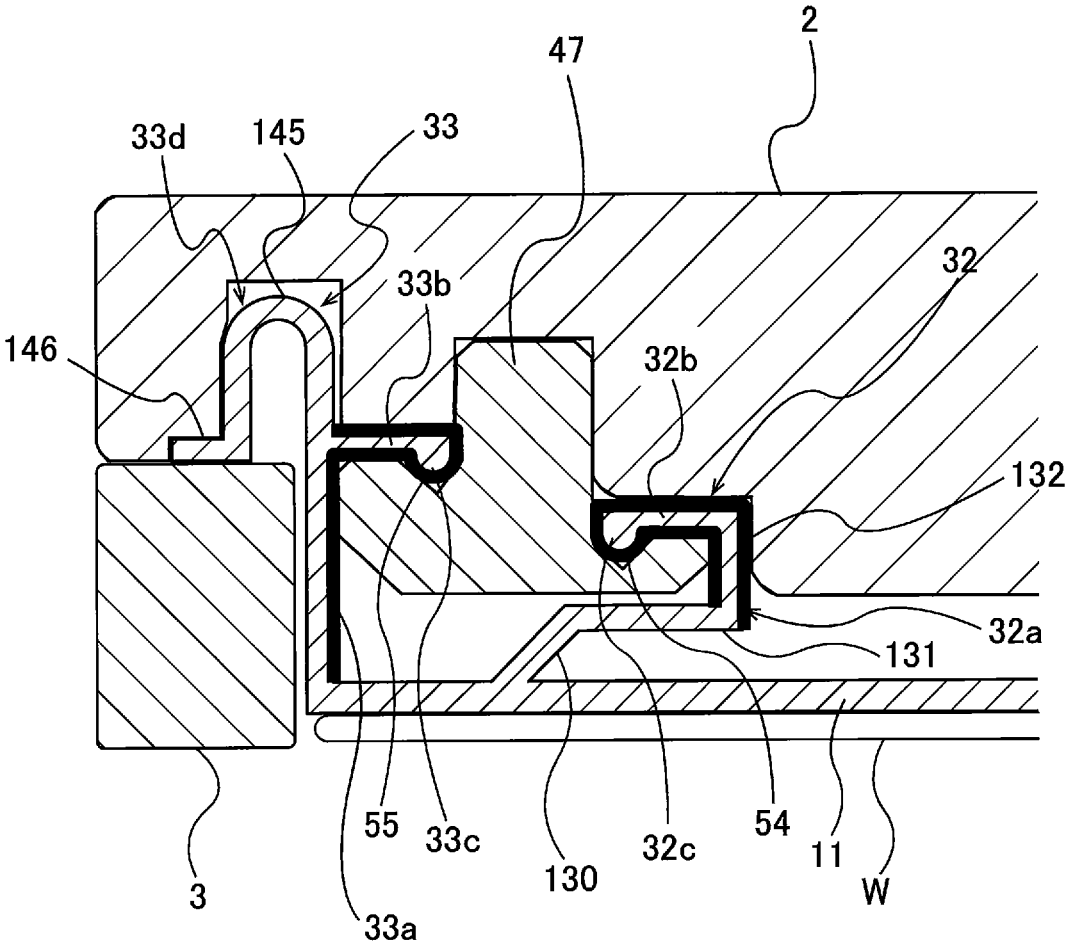
FIG. 6 is a view showing roughened surfaces of the elastic membrane according another embodiment.

FIG. 6 is a view showing roughened surfaces of the elastic membrane 10 according another embodiment. In FIG. 6 also, the roughened surfaces of the elastic membrane 10 is illustrated with thick lines.

In the embodiment shown in FIG. 6, the entire surface of the edge-circumferential-wall lip portion 33*b* as well as an inner circumferential surface of the edge-circumferential-wall body 33*a* are roughened. The inner circumferential surface of the edge-circumferential-wall body 33*a* is a surface which is in close contact with or may be in close contact with an outer circumferential surface of the second mounting ring 47, when securing the elastic membrane 10 to the head body 2. Therefore, roughening of the inner circumferential surface of the edge-circumferential-wall body 33*a* also enables the edge-circumferential-wall body 33*a* to be prevented from being in close contact with the second mounting ring 47. As a result, the edge-circumferential-wall body 33*a* can be smoothly and easily moved with respect to the second mounting ring 47, so that the elastic membrane 10 can be easily secured to the head body 2 while inhibiting the variation in the degree of deformation of the elastic membrane 10 in the circumferential direction.

As shown in FIG. 6, a surface of the third inner-circumferential-wall lip portion 32*b* of the third inner circumferential wall 32 may be roughened. In the embodiment shown in FIG. 6, the entire surface of the third inner-circumferential-wall lip portion 32*b* is roughened. In one embodiment, instead of roughening the entire surface of the third inner-circumferential-wall lip portion 32*b*, at least a part of the surface of the third inner-circumferential-wall lip portion 32*b* may be roughened. For example, only an upper surface or a lower surface of the third inner-circumferential-wall lip portion 32*b* may be roughened, or the upper surface and the lower surface of the third inner-circumferential-wall lip portion 32*b* except the seal projection 32*c* may be roughened.

Further, an inner circumferential surface and an outer circumferential surface of the vertical portion 132 of the third inner-circumferential-wall body 32*a* may be roughened. The inner circumferential surface of the vertical portion 132 of the third inner-circumferential-wall body 32*a* is a surface which is in close contact with or may be in close contact with the head body 2, when securing the elastic membrane 10 to the head body 2. The outer circumferential surface of the vertical portion 132 of the third inner-circumferential-wall body 32*a* is a surface which is in close contact with or may be in close contact with the second mounting member 47, when securing the elastic membrane 10 to the head body 2. Therefore, roughening of the inner circumferential surface and the outer circumferential surface of the third inner-circumferential-wall body 32*a* also enables the third inner-circumferential-wall body 32*a* to be prevented from being in close contact with the head body 2 and the second mounting ring 47. As a result, the third inner-circumferential-wall body 32*a* can be smoothly and easily moved with respect to the head body 2 and the second mounting member 47, so that the elastic membrane 10 can be easily secured to the head body 2 while inhibiting the variation in the degree of deformation of the elastic membrane 10 in the circumferential direction.

Figure 7:
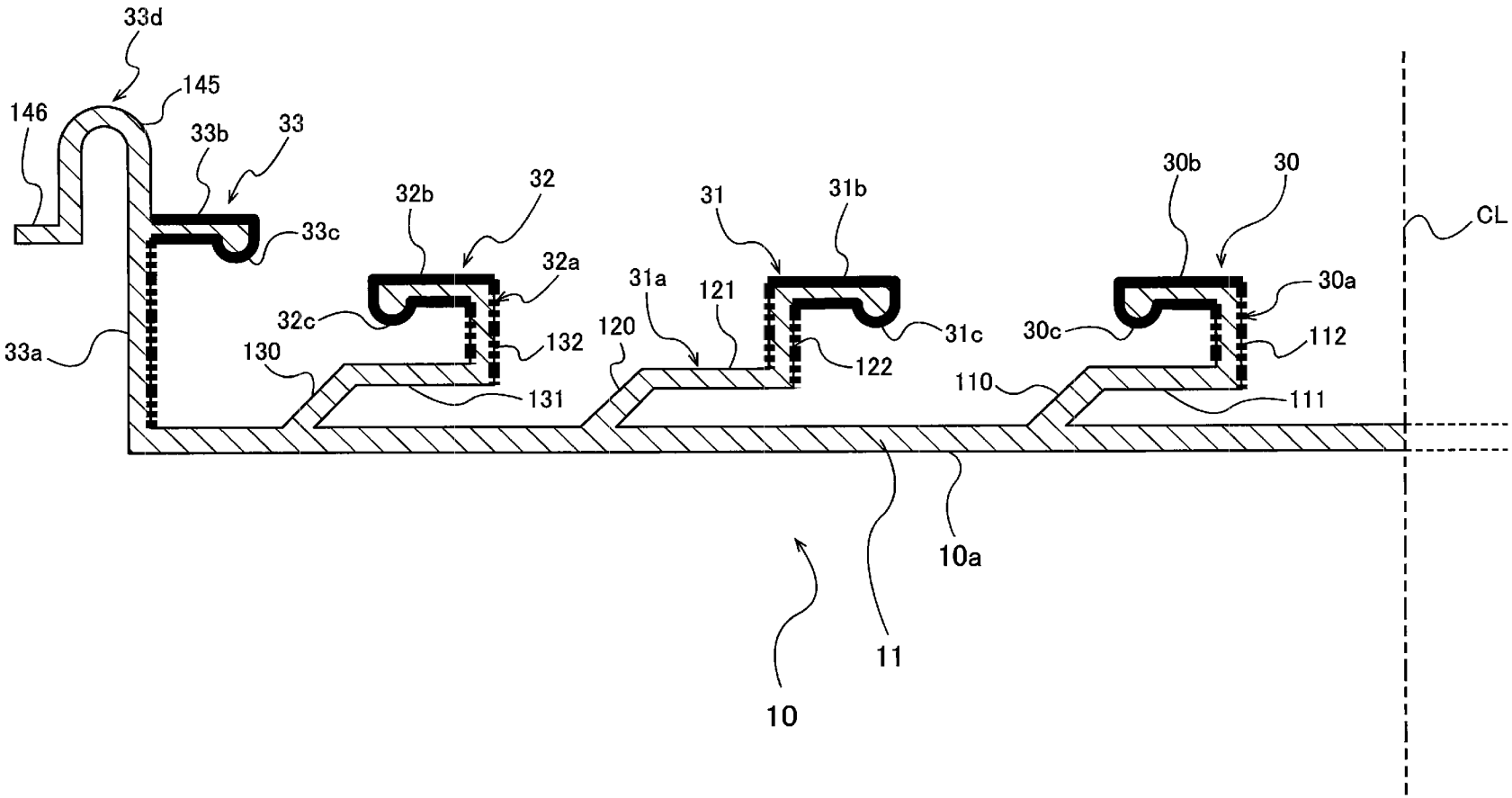
FIG. 7 is a view showing roughened surfaces of the elastic membrane according still another embodiment.

FIG. 7 is a view showing roughened surfaces of the elastic membrane 10 according to still another embodiment. In FIG. 7 also, the roughened surfaces of the elastic membrane 10 are illustrated with thick lines.

In the embodiment shown in FIG. 7, the entire surface of the edge-circumferential-wall lip portion 33*b* and the entire surface of the third inner-circumferential-wall lip portion 32*b* as well as the entire surface of the first inner-circumferential-wall lip portion 30*b* and the entire surface of the second inner-circumferential-wall lip portion 31*b* are roughened. Although, in the example illustrated, the surfaces of the first inner-circumferential-wall lip portion 30*b*, the second inner-circumferential-wall lip portion 31*b*, and the third inner-circumferential-wall lip portion 32*b* are roughened, respectively, the present invention is not limited to the embodiment. For example, any one or two surface of the first inner-circumferential-wall lip portion 30*b*, the second inner-circumferential-wall lip portion 31*b*, and the third inner-circumferential-wall lip portion 32*b* may be roughened. Further, similar to the edge-circumferential-wall lip portion 33*b* and the third inner-circumferential-wall lip portion 32*b* described above, at least a part of the first inner-circumferential-wall lip portion 30*b*, and at least a part of the second inner-circumferential-wall lip portion 31*b* may be roughened.

According to the embodiment shown in FIG. 7, the first inner-circumferential-wall lip portion 30*b* and the second inner-circumferential-wall lip portion 31*b* can be smoothly and easily moved with respect to the head body 2 and/or the first mounting ring 45. Therefore, the variation in the degree of deformation of the elastic membrane 10 in the circumferential direction can be further inhibited, and thus the elastic membrane 10 can be more easily secured to the head body 2

As shown by the thick two-dot chain line in FIG. 7, an inner circumferential surface and an outer circumferential surface of the vertical portion 112 of the first inner-circumferential-wall body 30*a* may be roughened, and an inner circumferential surface and an outer circumferential surface of the vertical portion 122 of the second inner-circumferential-wall body 31*a* may be roughened. Further, the inner circumferential surface of the edge-circumferential-wall body 33*a* of the edge circumferential wall 33 may be roughened, and the inner circumferential surface and the outer circumferential surface of the vertical portion 132 of the third inner-circumferential-wall body 32*a* may be roughened.

The inner circumferential surface of the vertical portion 112 of the first inner-circumferential-wall body 30*a* and the outer circumferential surface of the vertical portion 122 of the second inner-circumferential-wall body 31*a* are surfaces which are in close contact with or may be in close contact with the head body 2, when securing the elastic membrane 10 to the head body 2. The outer circumferential surface of the vertical portion 112 of the first inner-circumferential-wall body 30*a* and the inner circumferential surface of the vertical portion 122 of the second inner-circumferential-wall body 31*a* are surfaces which are in close contact with or may be in close contact with the first mounting member 45, when securing the elastic membrane 10 to the head body 2. Therefore, roughening of the inner circumferential surface and the outer circumferential surface of the vertical portion 112 of the first inner-circumferential-wall body 30*a*, and the inner circumferential surface and the outer circumferential surface of the vertical portion 122 of the second inner-circumferential-wall body 31*a* enables the first inner-circumferential-wall body 30*a* and the second inner-circumferential-wall body 31*a* to be prevented from being in close contact with the head body 2 and the second mounting ring 47. As a result, the first inner-circumferential-wall body 30*a* and the second inner-circumferential-wall body 31*a* can be smoothly and easily moved with respect to the head body 2 and the first mounting ring 45, so that the elastic membrane 10 can be more easily secured to the head body 2 while further inhibiting the variation in the degree of deformation of the elastic membrane 10 in the circumferential direction.

Figure 8:
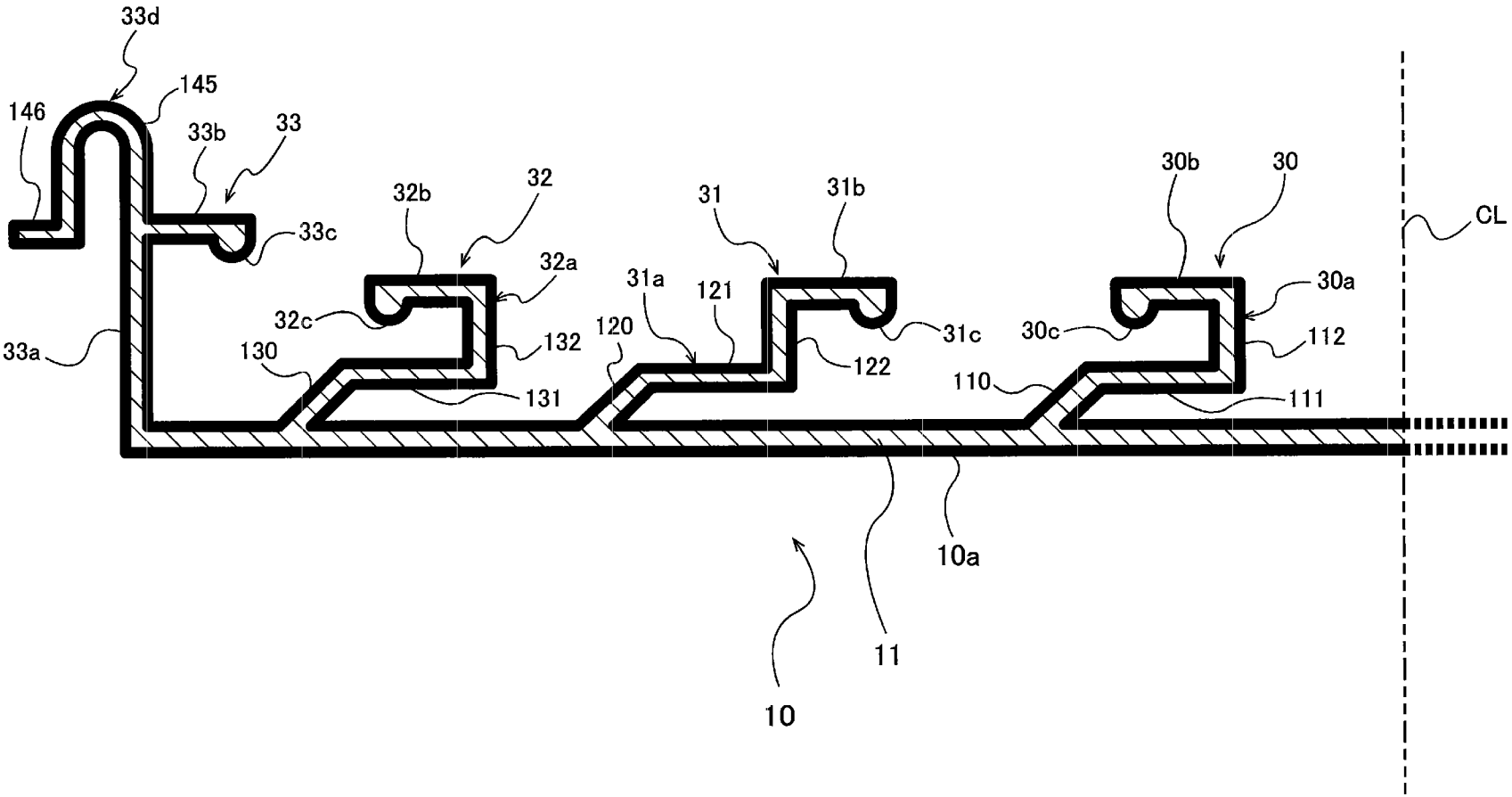
FIG. 8 is a view showing a roughened surface of the elastic membrane according still another embodiment.

FIG. 8 is a view showing a roughened surface of the elastic membrane 10 according to still another embodiment. In FIG. 8 also, the roughened surface of the elastic membrane 10 is illustrated with a thick line. In the embodiment shown in FIG. 8, the entire surface of the elastic membrane 10 is roughened. With this structure also, the elastic membrane 10 can be smoothly and easily moved with respect to the head body 2 and the mounting rings 45, 47, so that the elastic membrane 10 can be easily secured to the head body 2 while inhibiting the variation in the degree of deformation of the elastic membrane 10 in the circumferential direction. Further, since the entire surface of the elastic membrane 10 is roughened, the surface treatment of the elastic membrane 10 can be easily performed, resulting in manufacturing the elastic membrane 10 inexpensively. For example, the entire inner surface of the molding die for manufacturing the elastic membrane 10 may be subjected to surface treatment, such as sandblasting, wet blasting, or roughening using a tool such as a file, so that the molding die can be easily manufactured and thus the elastic membranes 10 can be manufactured inexpensively.

Further, the surfaces of the first mounting ring 45 and/or the second mounting ring 47 may be covered with a friction-reducing film. In this specification, the "friction-reducing film" is a general term for a film made of a low-friction material, and the "low-friction material" means a material whose coefficient of friction with respect to the elastic membrane 10 is smaller than that of the material of the mounting ring 45, 47 (mounting member) and the material of the head body 2. The low-friction material is not particularly limited as long as the coefficient of friction with respect to the elastic membrane 10 is smaller than that of the materials of the mounting members 45, 47 and the head body 2, but is, for example, a fluororesin, such as Teflon (registered trademark).

Such friction-reducing film may be formed in the entire surfaces of the mounting rings 45, 47, or may be formed in only surfaces which are in contact with, or may be in contact with the elastic membrane 10. The friction-reducing film effectively reduces the close contact of the elastic membrane 10 with the mounting rings 45, 47 and the head body 2, whereby each of the lip portions 30*b*, 31*b*, 32*b*, 33*b* of the elastic membrane 10 can be smoothly and easily moved with respect to the mounting rings 45, 47.

In the embodiments described above, a part or a plurality of parts of the surface of the elastic membrane 10, or the entire surface of the elastic membrane 10 is roughened to reduce the contact area between the elastic membrane 10 and the head body 2, and/or the contact area between the elastic membrane 10 and the mounting rings 45, 47. With this structure, the elastic membrane 10 can be smoothly moved with respect to the head body 2 and the mounting rings 45, 47. However, the same effect can be obtained by roughening of surfaces of the mounting rings 45, 47, or surface of the head body 2 facing the elastic membrane 10.

More specifically, instead of roughening each portions of the elastic membrane 10 shown by thick lines and two-dot chain lines in FIGS. 5 to 7, the surfaces of the mounting rings 45, 47 and the surfaces of the head body 2 facing these portions are roughened. In this case, the entire surface of the elastic membrane 10 is a flat surface without any protrusions and/or recesses. Roughening of the surfaces of the mounting rings 45, 47 and/or the surfaces of the head body 2 is performed by a surface treatment, such as, sandblasting, wet blasting, or roughening using a tool such as a file, for example. In one embodiment, the surface of the mounting rings 45, 47 and the surfaces of the head body 2 may be subjected to the texturing treatment to thereby be roughened.

Figure 9:
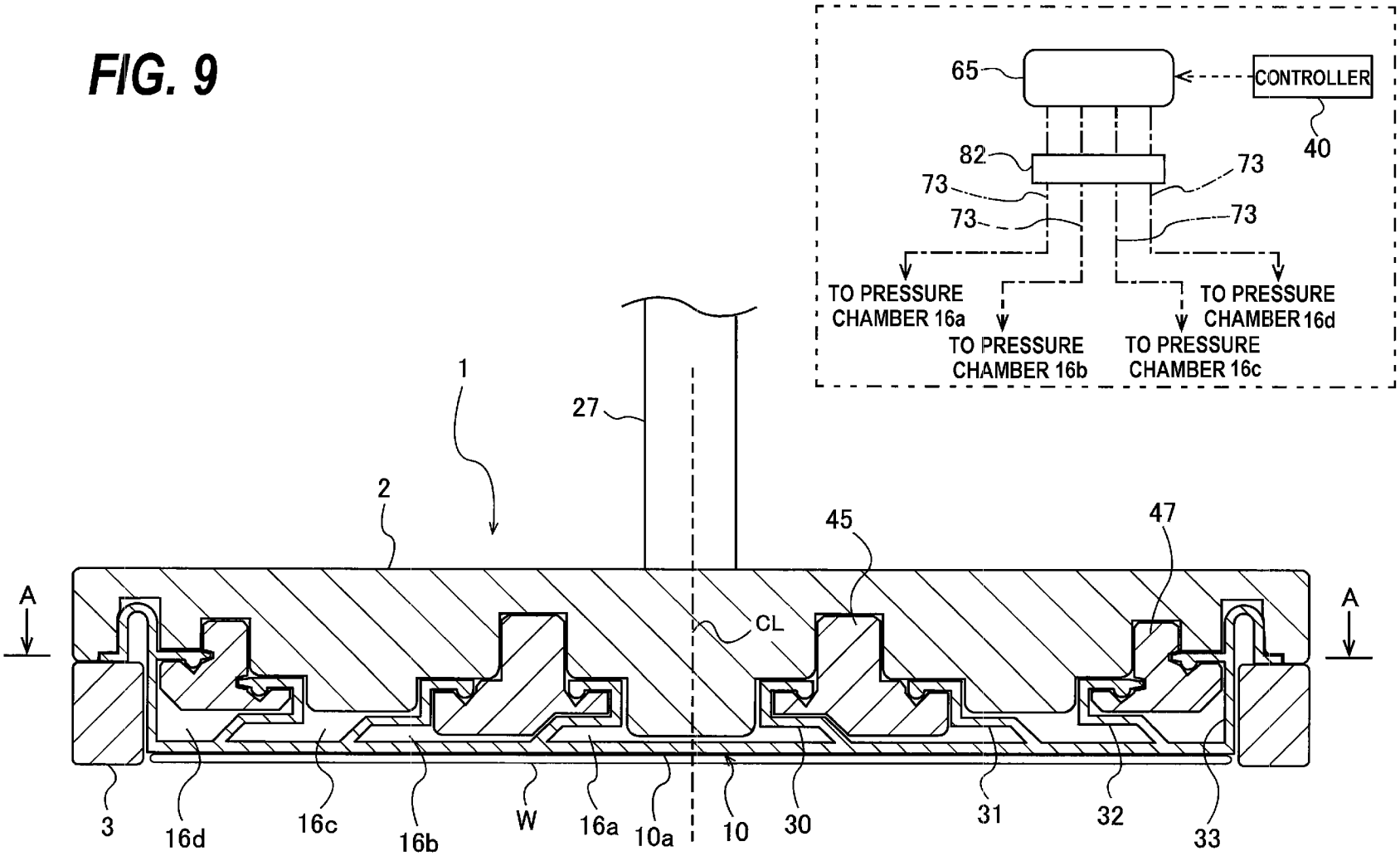
FIG. 9 is a schematic cross-sectional view of the substrate holding device according to another embodiment.
Figure 10:
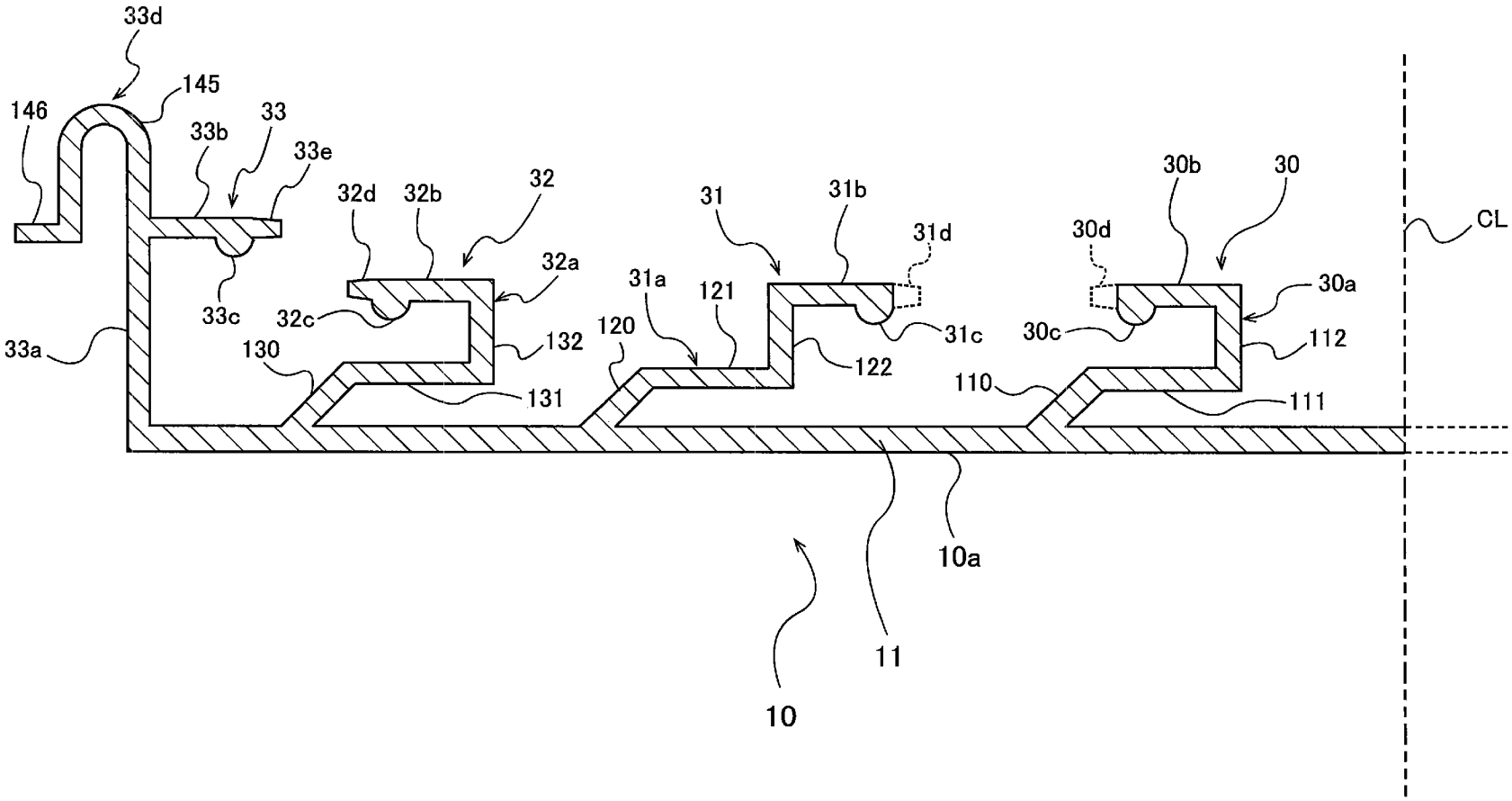
FIG. 10 is an enlarged cross-sectional view showing a portion of the elastic membrane shown in FIG. 9.
Figure 11:
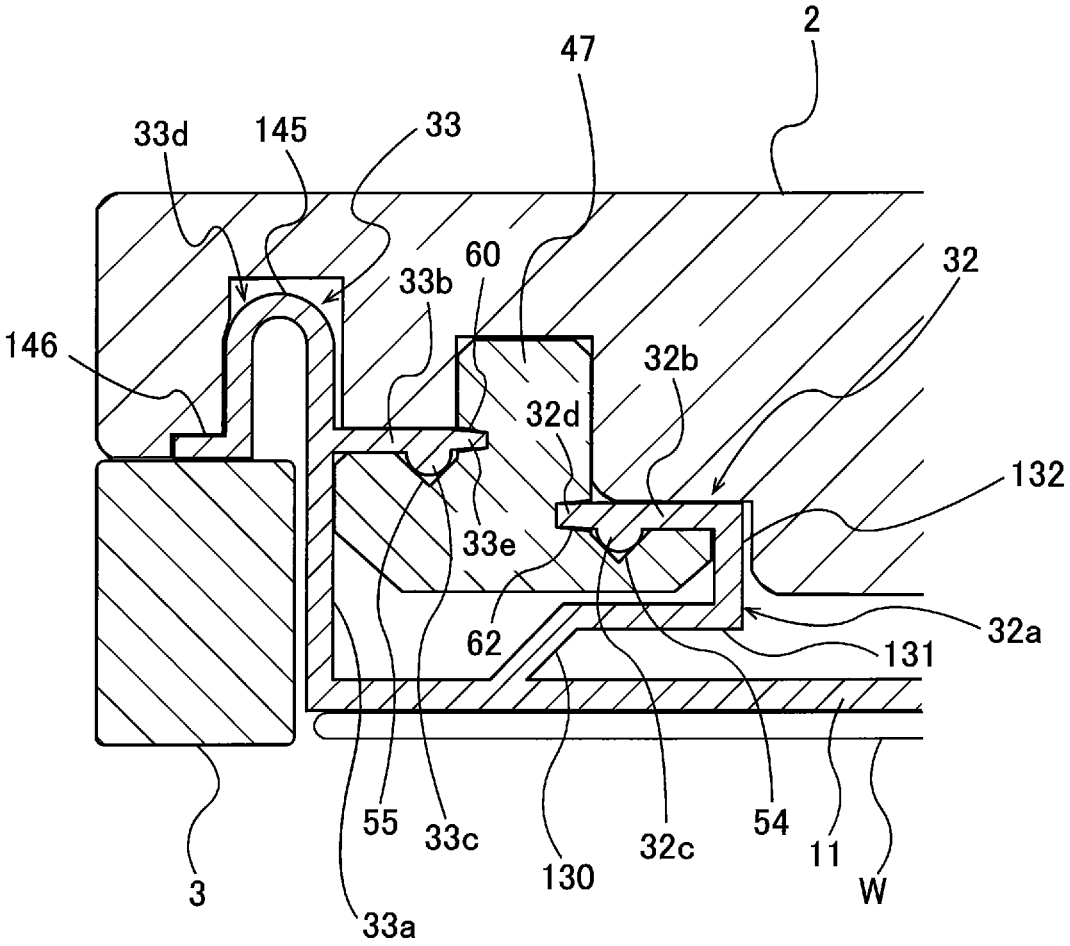
FIG. 11 is an enlarged cross-sectional view of the vicinity of the second mounting ring shown in FIG. 9.
Figure 12:
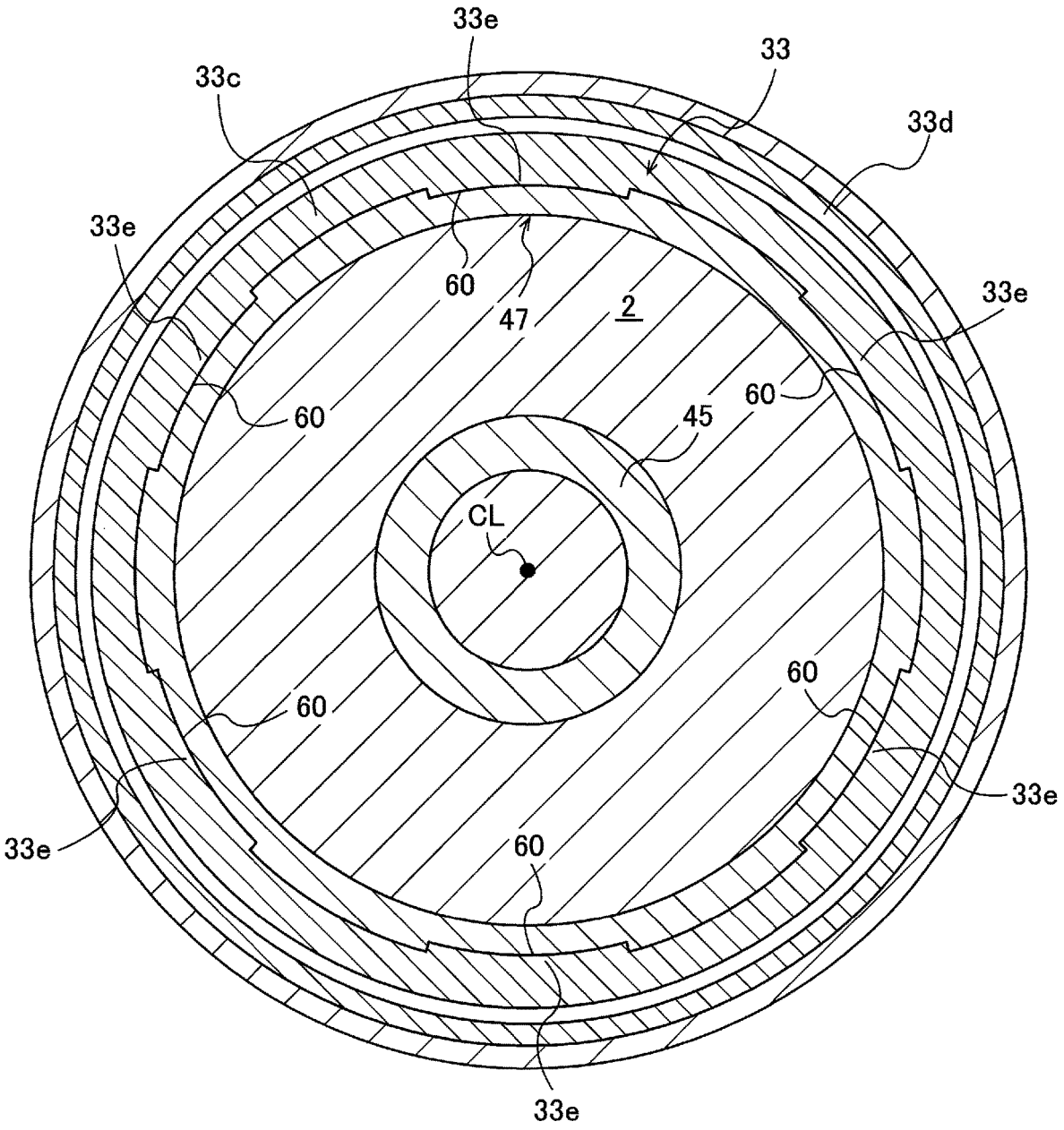
FIG. 12 is a cross-sectional view taken along line A-A in FIG. 9.

Next, another example of configuration of the polishing head 1 will be described with reference to FIG. 9. FIG. 9 is a schematic cross-sectional view of the polishing head (substrate holding device) 1 according to another embodiment. FIG. 10 is an enlarged cross-sectional view showing a portion of the elastic membrane shown in FIG. 9. More specifically, FIG. 10 illustrates a schematic cross-section of a half of the elastic membrane 10 divided by the vertical plane containing the central axis CL of the elastic membrane 10. FIG. 11 is an enlarged cross-sectional view of the vicinity of the second mounting ring shown in FIG. 9, and FIG. 12 is a cross-sectional view taken along line A-A in FIG. 9. Structures of this embodiment, which will not be specifically described, are the same as those of the above-described embodiments, and duplicate explanations will be omitted.

In this embodiment, the edge-circumferential-wall lip portion 33*b* of the edge circumferential wall 33 has a plurality of edge-circumferential-wall projections 33*e* protruding radially inwardly from the tip (inner circumferential end) thereof. As shown in FIG. 12, the edge-circumferential-wall lip portion 33*b* according to this embodiment has six edge-circumferential-wall projections 33*e* arranged at equal intervals along the circumferential direction of the edge circumferential wall 33. Each edge-circumferential-wall projections 33*e* has an arc shape as viewed in horizontal cross-section as shown in FIG. 12, and protrudes radially inwardly and horizontally of the edge-circumferential-wall lip portion 33*b* from the tip of the edge-circumferential-wall lip portion 33*b*. In the following description, the edge-circumferential-wall projection 33*e* protruding radially of the edge-circumferential-wall lip portion 33*b* may be referred to as a "lateral edge projection 33*e*".

As shown in FIGS. 11 and 12, the second mounting ring 47 has a plurality (six in FIG. 12) of recesses 60 formed in correspondence with each of the edge projections 33*e*. These recesses 60 have a shape corresponding to the lateral edge projections 33*e*, respectively, and are arranged at equal intervals along the circumferential direction of the second mounting ring 47.

When the elastic membrane 10 is secured to the head body 2 through the mounting rings 45, 47, the lateral edge projections 33*e* provided in the edge-circumferential-wall lip portion 33*b* of the edge circumferential wall 33 are fitted into the recesses 60 formed in the second mounting ring 47. In this state, the second mounting ring 47 is secured to the head body 2 by fasteners (not shown), such as a screw, to thereby secure the edge circumferential wall 33 to the head body 2. More specifically, in the state where the plurality of lateral edge projections 33*e* arranged along the circumferential direction of the edge circumferential wall 33 are fitted into the recesses 60 formed in the second mounting ring 47, the edge circumferential wall 33 is secured to the head body 2 through the second mounting ring 47. Accordingly, the edge circumferential wall 33 can be secured to the head body 2 while inhibiting the deformation of the edge circumferential wall 33 in the circumferential direction to the minimum.

Further, when the elastic membrane 10 is secured to the head body 2 through the mounting rings 45, 47, the plurality of edge-circumferential-wall projections 33*e* serves as guides with respect to the second mounting ring 47. Therefore, the elastic membrane 10 can be easily secured to the head body 2. In order to easily insert the lateral edge projections 33*e* into the recesses 60, the lateral edge projections 33*e* preferably have a tapered shape whose cross-sectional area gradually decreases towards the tip thereof.

Although, in the embodiment shown in FIGS. 11 and 12, the six lateral edge projections 33*e* and the six recesses 60 corresponding to each of these lateral edge projections 33*e* are provided, the number of lateral edge protrusions 33*e* and the number of recesses 60 are not limited to this example. The number of lateral edge projections 33*e* and the number of recesses 60 are freely-selected as long as they are arranged at equal intervals in the circumferential direction of the edge circumferential wall 33. It is preferred that the number of lateral edge projections 33*e* and the number of recesses 60 are in the range of 2 to 8. Furthermore, although each lateral edge projections 33*e* has a tapered shape in a vertical cross-sectional view shown in FIG. 11 and has an arc shape in the horizontal cross-sectional view shown in FIG. 12, the shape of the lateral edge projection 33*e* also is not limited to this example. For example, the lateral edge projection 33*e* may have a rectangular shape or a triangular shape as viewed in the vertical cross-section. It is preferred that the lateral edge projections 33*e* are rotationally symmetrical with the central axis CL as an axis of symmetry (see FIG. 12).

As shown in FIGS. 10 and 11, the third inner-circumferential-wall lip portion 32*b* of the third inner circumferential wall 32 may have a plurality of inner-circumferential-wall projections 32*d* protruding radially outward and horizontally of the inner circumferential wall 32 from the tip (outer circumferential end) thereof. In the following description, the inner-circumferential-wall projection 32*d* protruding radially of the third inner circumferential wall 32 may be referred to as a "lateral inner projections 32*d*".

The third inner-circumferential-wall lip portion 32*b* according to this embodiment has a plurality of lateral inner projections 32*d* arranged at equal intervals along the circumferential direction of the third inner circumferential wall 32. Similarly to the lateral edge projections 33*e*, the number of lateral inner projections 32*d* is freely-selected as long as they are arranged at equal intervals in the circumferential direction of the third inner circumferential wall 32, and is preferably in the range of 2 to 8. Further, the shape of the lateral inner projection 32*d* also is freely-selected, similarly to the lateral edge projection 33*e*. Each lateral inner projections 32*d* preferably has a tapered shape whose cross-sectional area decreases toward the tip thereof. It is preferred that the lateral inner projections 32*d* are rotationally symmetrical with the central axis CL as an axis of symmetry.

The second mounting ring 47 has a plurality of recesses 62 formed in correspondence with each of lateral inner projections 32*d*. When the elastic membrane 10 is secured to the head body 2 through the mounting rings 45, 47, the plurality of lateral inner projections 32*d* arranged along the circumferential direction of the third inner circumferential wall 32 are fitted into the recesses 62 formed in the second mounting ring 47, and in this state, the third inner circumferential wall 32 is secured to the head body 2 through the second mounting ring 47.

The elastic membrane 10 has the lateral inner projections 32*d* of the third inner-circumferential-wall lip portion 32*b* in addition to the lateral edge projections 33*e* of the edge-circumferential-wall lip portion 33*b*, resulting in enabling the variation in the degree of deformation of the elastic membrane 10 in the circumferential direction to be more effectively inhibited.

Further, as shown by the dotted lines in FIG. 10, the first inner-circumferential-wall lip portion 30*b* of the first inner circumferential wall 30 and the second inner-circumferential-wall lip portion 31*b* of the second inner circumferential wall 31 also may have a plurality of lateral inner projections 30*d*, 31*d* protruding radially from their tips, respectively. The lateral inner projections 30*d* of the first inner-circumferential-wall lip portion 30*b* protrude radially outward and horizontally from the tip of the first inner-circumferential-wall lip portion 30*b*, and the lateral inner projections 31*d* of the second inner circumferential wall lip portion 31*b* protrude radially inward and horizontally from the tip of the second inner-circumferential-wall lip portion 31*b*. The lateral inner projections 30*d* of the first inner-circumferential-wall lip portion 30*b* have the same structure as the lateral inner projections 32*d* of the third inner-circumferential-wall lip portion 32*b*. The lateral inner projections 31*d* of the second inner-circumferential-wall lip portion 31*b* have the same structure as the lateral inner projections 32*d* of the third inner circumferential wall 32, except that a protruding direction thereof is different from the lateral inner projections 32*d*.

The first mounting ring 45 has a plurality of recesses formed in correspondence with the lateral inner projections 30*d* of the first inner-circumferential-wall lip portion 30*b*, and a plurality of recesses formed in correspondence with the lateral inner projections 31*d* of the second inner-circumferential-wall lip portion 31*b*. When the elastic membrane 10 is secured to the head body 2 through the mounting rings 45, 47, the plurality of lateral inner projections 30*d* arranged along the circumferential direction of the first inner circumferential wall 30, and the plurality of lateral inner projections 31*d* arranged along the circumferential direction of the second inner circumferential wall 31 are respectively fitted into the plurality of recesses formed in the first mounting ring 45, and in this state, the first inner circumferential wall 30 and the second inner circumferential wall 31 are secured to the head body 2 through the first mounting 45.

In this manner, in addition to the edge-circumferential-wall lip portion 33*b*, each of the first inner-circumferential-wall lip portion 30*b*, the second inner-circumferential-wall lip portion 31*b*, and the third inner-circumferential-wall lip portion 32*b* may have lateral inner projections 30*d*, 31*d*, and 32*d*. In one embodiment, any one or two of the first inner-circumferential-wall lip portion 30*b*, the second inner-circumferential-wall lip portion 31*b*, and the third inner-circumferential-wall lip portion 32*b* may have the lateral inner projections. With such a configuration, the variation in the degree of deformation of the elastic membrane 10 in the circumferential direction can be more effectively inhibited. Further, the lateral inner projections 30*d* of the first inner-circumferential-wall lip portion 30*b* and the lateral inner projection 31*d* of the second inner-circumferential-wall lip portion 31*b* serve as guides with respect to the first mounting ring 45, so that the elastic membrane 10 can be more easily secured to the head body 2.

Figure 13:
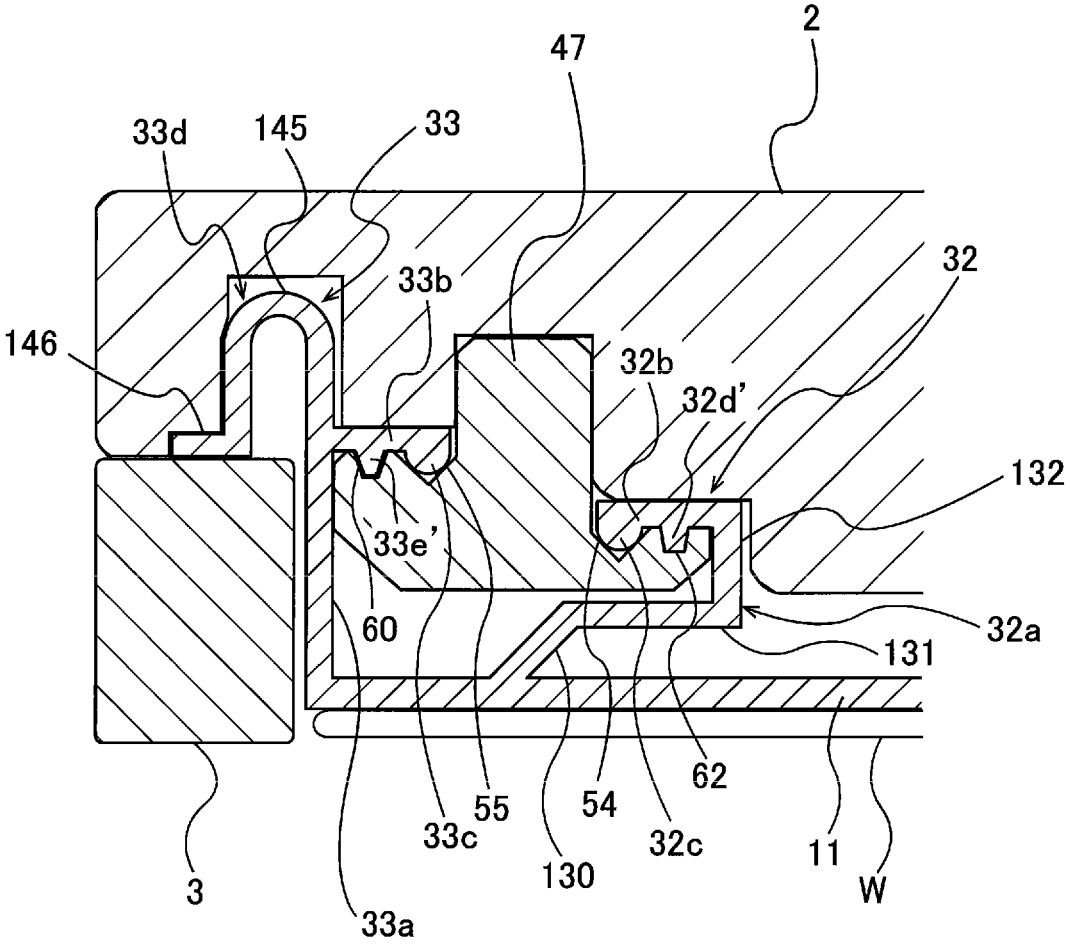
FIG. 13 is an enlarged cross-sectional view of the vicinity of the edge circumferential wall in the elastic membrane according to another embodiment.
Figure 14:
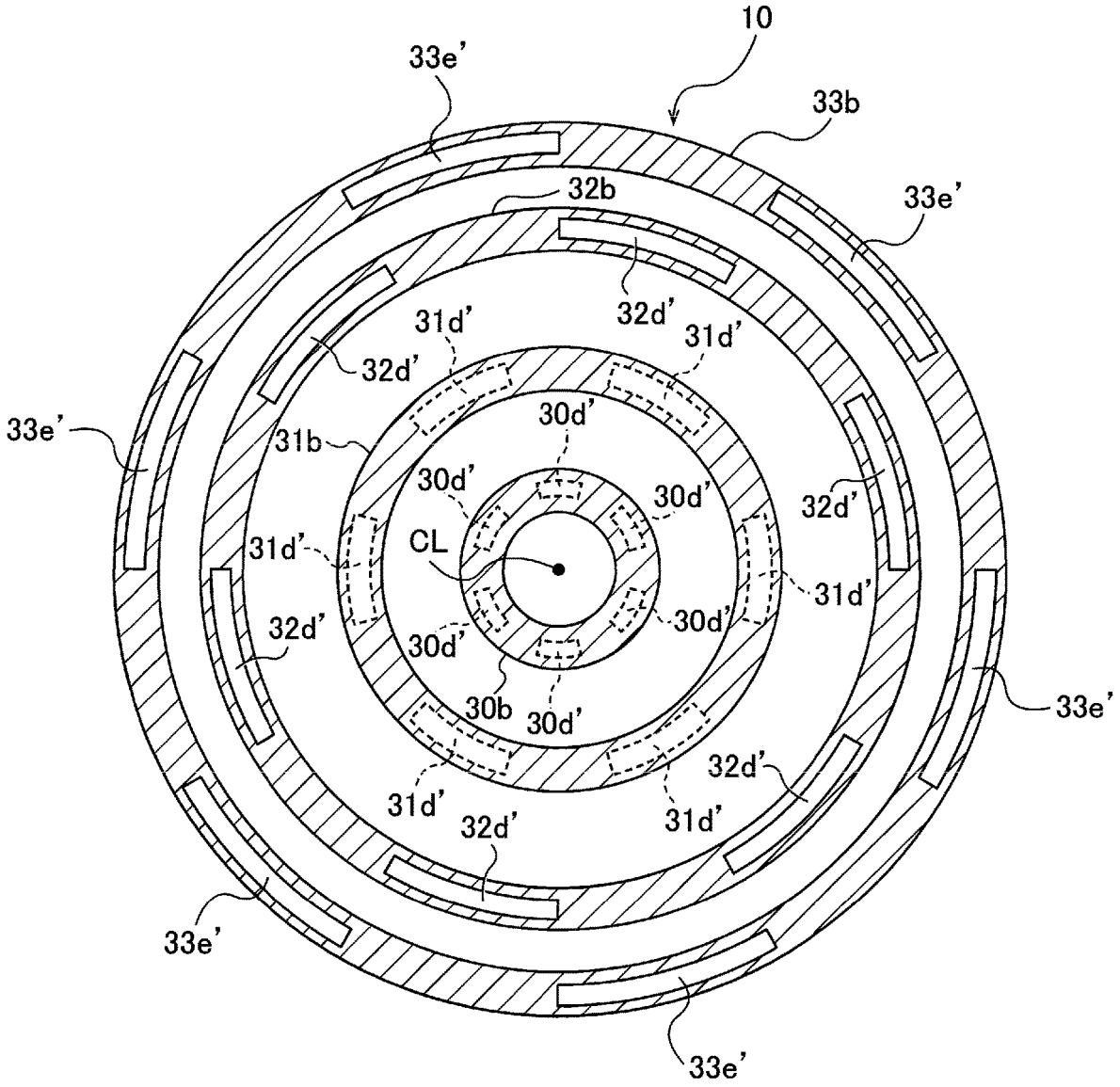
FIG. 14 is a bottom view of the elastic membrane shown in FIG. 13.

FIG. 13 is an enlarged cross-sectional view showing the vicinity of the edge circumferential wall 33 in the elastic membrane 10 according to another embodiment. FIG. 14 is a bottom view of the elastic membrane 10 shown in FIG. 13. In FIG. 14, each of lip portions 30*b* to 33*b* of the circumferential walls 30 to 33 are extracted and illustrated. Structures of this embodiment, which will not be specifically described, are the same as those of the above-described embodiments, and duplicate explanations will be omitted.

The edge-circumferential-wall lip portion 33*b* of the edge circumferential wall 33 shown in FIGS. 13 and 14 has a plurality (six in FIG. 14) of edge projections 33*e*' protruding downwardly from a lower surface thereof. In the following description, the edge projection 33*e*' protruding downwardly from the lower surface of the edge-circumferential-wall lip portion 33*b* may be referred to as a "vertical edge projection 33*e*".

The plurality of vertical edge projections 33*e*' are arranged at equal intervals in the radial direction of the edge circumferential wall 33. The second mounting ring 47 has a plurality of recesses 60 formed in correspondence with the plurality of vertical edge projections 33*e*'. Similarly to the lateral edge projections 33*e*, the number of vertical edge projections 33*e*' and the number of recesses 60 are freely-selected as long as they are arranged at equal intervals in the circumferential direction of the edge circumferential wall 33, and are preferably in the range of 2 to 8, respectively. Furthermore, the shape of the vertical edge projection 33*e*' also is freely-selected, similarly to the lateral edge projections 33*e*. It is preferred that each vertical edge projections 33*e*' has a tapered shape whose cross-sectional area decreases toward the tip thereof (see FIG. 13), and has an arc shape as viewed in the horizontal cross-section (see FIG. 14). Furthermore, it is preferred that the plurality of vertical edge projections 33*e*' are rotationally symmetrical with the central axis CL as an axis of symmetry.

In this embodiment also, the edge circumferential wall 33 is secured to the head body 2 through the second mounting ring 47 in a state where the plurality of vertical edge projections 33*e*' arranged along the circumferential direction of the edge circumferential wall 33 are fitted into the recesses 60 formed in the second mounting ring 47. Accordingly, the edge circumferential wall 33 can be secured to the head body 2 while inhibiting the deformation of the edge circumferential wall 33 in the circumferential direction to the minimum. Further, when the elastic membrane 10 is secured to the head body 2 through the mounting rings 45, 47, the plurality of vertical edge projections 33*e*' serve as guides with respect to the second mounting ring 47. Accordingly, the elastic membrane 10 can be easily secured to the head body 2. In this manner, the edge-circumferential-wall projections may protrude downwardly from the lower surface of the edge-circumferential-wall lip portion 33*b*, such as the vertical edge projections 33*e*'.

As shown in FIGS. 13 and 14, the third inner-circumferential-wall lip portion 32*b* of the third inner circumferential wall 32 may have a plurality (six in FIG. 14) of inner projections 32*d*' protruding downwardly from a lower surface thereof. In the following description, the inner projection 32*d*' protruding downwardly from the lower surface of the third inner-circumferential-wall lip portion 32*b* may be referred to as a "vertical inner projection 32*d*'".

The plurality of vertical inner projections 32*d*' are arranged at equal intervals along the circumferential direction of the third inner circumferential wall 32. The second mounting ring 47 has a plurality of recesses 62 formed in correspondence with the plurality of vertical inner projections 32*d*'. Similarly to the vertical edge projections 33*e*', the number of vertical inner projections 32*d*' and the number of recesses 62 also is freely-selected as long as they are arranged at equal intervals in the circumferential direction of the third inner circumferential wall 32, and are preferably in the range of 2 to 8, respectively. Furthermore, the shape of the vertical inner projection 32*d*' also is freely-selected, similarly to the vertical edge projections 33*e*'. It is preferred that the vertical inner projection 32*d*' has a tapered shape whose cross-sectional area decreases toward the tip thereof (see FIG. 13), and has an arc shape as viewed in horizontal cross-section (see FIG. 14). Furthermore, it is preferred that the plurality of vertical inner projections 32*d*' are rotationally symmetrical with the central axis CL as an axis of symmetry.

As shown by the dotted lines in FIG. 14, the first inner-circumferential-wall lip portion 30*b* of the first inner circumferential wall 30 and the second inner-circumferential-wall lip portion 31*b* of the second inner circumferential wall 31 also may have a plurality of vertical inner projections 30*d*', 31*d*' protruding downwardly from their lower surfaces, respectively. The vertical inner projections 30*d*' of the first inner-circumferential-wall lip portion 30*b* and the vertical inner projections 31*d*' of the second inner-circumferential-wall lip portion 31*b* have the same configuration as the vertical inner projections 32*d*' of the third inner-circumferential-wall lip portion 32*b*. Although not shown, the first mounting ring 45 has a plurality of recesses formed in correspondence with the vertical inner projections 30*d*' of the first inner-circumferential-wall lip portion 30*b*, and a plurality of recesses formed in correspondence with the vertical inner projections 31*d*' of the second inner-circumferential-wall lip portion 31*b*.

In this manner, in addition to the edge-circumferential-wall lip portion 33*b*, each of the first inner-circumferential-wall lip portion 30*b*, the second inner-circumferential-wall lip portion 31*b*, and the third inner-circumferential-wall lip portion 32*b* may have the vertical inner projections 30*d*', 31*d*', and 32*d*'. In one embodiment, any one or two of the first inner-circumferential-wall lip portion 30*b*, the second inner-circumferential-wall lip portion 31*b*, and the third inner-circumferential-wall lip portion 32*b* may have the vertical inner projections. With such a configuration, the variation in the degree of deformation of the elastic membrane 10 in the circumferential direction can be more effectively inhibited. Furthermore, the vertical inner projections 30*d*' of the first inner-circumferential-wall lip portion 30*b* and the vertical inner projection 31*d*' of the second inner-circumferential-wall lip portion 31*b* serve as guides with respect to the first mounting ring 45, so that the elastic membrane 10 can be more easily secured to the head body 2.

Figure 15:
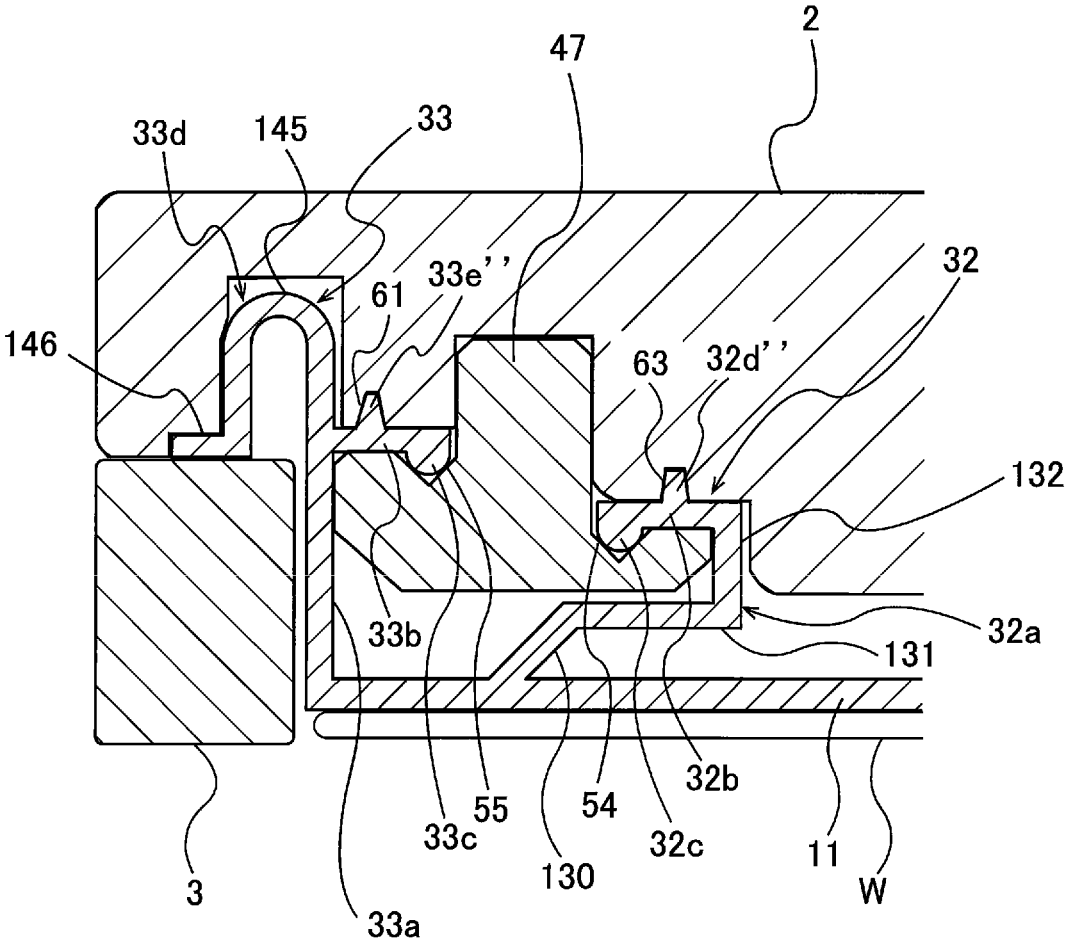
FIG. 15 is an enlarged cross-sectional view showing the vicinity of the edge circumferential wall of the elastic membrane according to still another embodiment.

FIG. 15 is an enlarged cross-sectional view showing the vicinity of the edge circumferential wall 33 of the elastic membrane 10 according to still another embodiment. Structures of this embodiment, which will not be specifically described, are the same as those of the embodiments shown in FIGS. 13 and 14, and duplicate explanations will be omitted.

The edge-circumferential-wall lip portion 33*b* of the edge circumferential wall 33 shown in FIG. 15 has a plurality of vertical edge projections 33*e*" protruding upwardly from an upper surface thereof. In this embodiment also, the plurality of vertical edge projections 33*e*" are arranged at equal intervals along the circumferential direction of the edge circumferential wall 33. The head body 2 has a plurality of recesses 61 formed in correspondence with the vertical edge projections 33*e*".

In this embodiment, the edge circumferential wall 33 is secured to the head body 2 through the second mounting ring 47 in a state where the plurality of vertical edge protrusions 33*e*" arranged along the circumferential direction of the edge circumferential wall 33 are fitted into the recesses 61 formed in the head body 2. In this case also, the edge circumferential wall 33 can be secured to the head body 2 while inhibiting the deformation of the edge circumferential wall 33 in the circumferential direction to the minimum. Further, when the elastic membrane 10 is secured to the head body 2 through the mounting rings 45, 47, the plurality of vertical edge projections 33*e*" serve as guides with respect to the head body 2. Accordingly, the elastic membrane 10 can be easily secured to the head body 2. In this manner, the edge-circumferential-wall projections may protrude upwardly from the upper surface of the edge-circumferential-wall lip portion 33*b*, such as the vertical edge projections 33*e*".

As shown in FIG. 15, the third inner-circumferential-wall lip portion 32*b* of the third inner circumferential wall 32 also may have vertical inner projections 32*d*" protruding from an upper surface thereof. The head body 2 has a plurality of recesses 63 formed in correspondence with the vertical inner projections 32*d*". Although not shown, the first inner-circumferential-wall lip portion 30*b* of the first inner circumferential wall 30 and the second inner-circumferential-wall lip portion 31*b* of the second inner circumferential wall 31 also may have vertical inner projections protruding from their top surfaces, respectively. In this case, the head body 2 has a plurality of recesses formed in correspondence with the vertical inner projections of the first inner-circumferential-wall lip portion 30*b* and the vertical inner projections of the second inner-circumferential-wall lip portion 31*b*. In one embodiment, any one or two of the first inner-circumferential-wall lip portion 30*b*, the second inner-circumferential-wall lip portion 31*b*, and the third inner-circumferential-wall lip portion 32*b* may have the vertical inner projections.

With this configuration also, the variation in the circumferential deformation of the elastic film 10 can be effectively inhibited. Furthermore, the vertical inner protrusions of the first inner-circumferential-wall lip portion 30*b* and the vertical inner protrusions of the second inner-circumferential-wall lip portion 31*b* also serve as guides with respect to the head body 2, so that the elastic film 10 can be easily secured to the head body 2.

Figure 16:
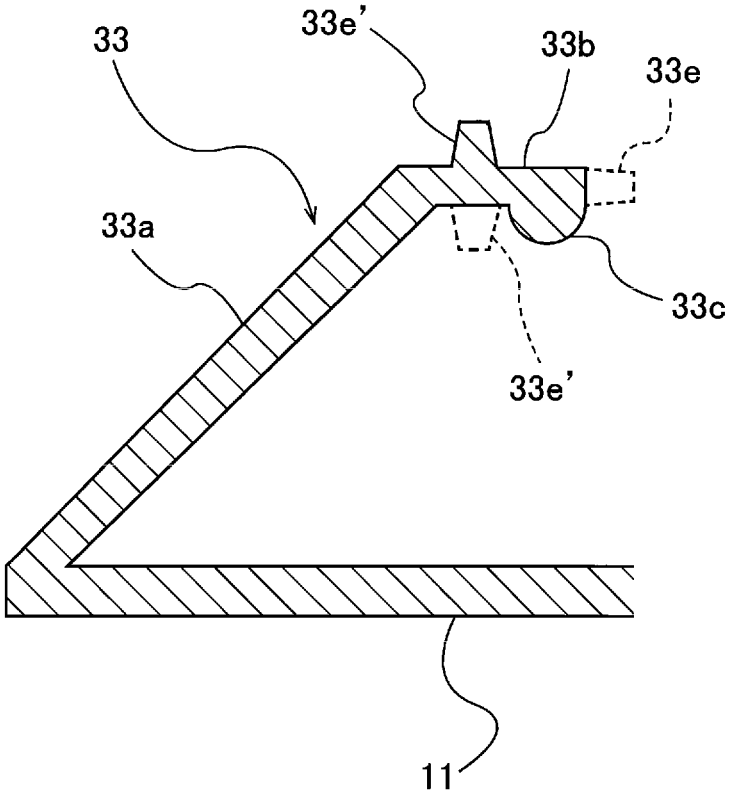
FIG. 16 is an enlarged schematic view showing the edge circumferential wall of the elastic membrane according to still another embodiment.

FIG. 16 is an enlarged schematic view showing the edge circumferential wall 33 of the elastic membrane 10 according to still another embodiment. Structures of this embodiment, which will not be specifically described, are the same as those of the above-described embodiments, and duplicate explanations will be omitted.

The edge circumferential wall 33 shown in FIG. 16 has an edge-circumferential-wall body 33*a* extending diagonally upwardly from the circumferential end of the contacting portion 11, and an edge-circumferential-wall lip portion 33*b* extending from a tip of the edge-circumferential-wall body 33*a*. Although, in the embodiments described above, the edge-circumferential-wall body 33*a* extends upwardly from the circumferential end of the contacting portion 11 in the vertical direction, the present invention is not limited to these embodiments. The shape of the edge-circumferential-wall body 33*a* can be freely-selected, and for example, the edge-circumferential-wall body 33*a* may extend diagonally upward as shown in FIG. 16.

Furthermore, the edge-circumferential-wall lip portion 33*b* of the edge circumferential wall 33 shown in FIG. 16 has the edge projections 33*e*" protruding upwardly from the upper surface thereof. However, as shown by the dotted lines in FIG. 16, the edge-circumferential-wall lip portion 33*b* may have the edge projections 33*e*' protruding downwardly from the lower surface of the edge-circumferential-wall lip portion 33*b*, or may have lateral edge projections 33*e*' protruding from the tip of the edge-circumferential-wall lip portion 33*b* in the radial direction.

Although not shown, the shapes of the inner-circumferential-wall bodies 30*a*, 31*a*, and 32*a* of the inner circumferential walls 30, 31, and 32 also are freely-selected, and may extend diagonally upwardly from the contacting portion 11, such as the edge circumferential wall 33 shown in FIG. 16. Further, the shapes of the inner-circumferential-wall bodies 30*a*, 31*a*, and 32*a* of the inner circumferential walls 30, 31, and 32 may be the same as or different from each other.

Although, in the embodiments described above, the edge-circumferential-wall lip portion 33*b* of the edge circumferential wall 33 has any of the lateral edge projection 33*e*, the vertical edge projection 33*e*', and the vertical edge projection 33*e*", the present invention is not limited to these embodiments. For example, the edge-circumferential-wall lip portion 33*b* may have any two of the lateral edge projections 33*e*, the vertical edge projections 33*e*' and the vertical edge projections 33*e*", or may have all of these projections 33*e*, 33*e*', and 33*e*". Similarly, each of the inner-circumferential-wall lip portions 30*b* to 32*b* may have any two of the lateral inner projections protruding radially from the tip of each of the inner-circumferential-wall lip portions 30*b* to 32*b*, the vertical inner protrusions protruding from the upper surface of each of the inner-circumferential-wall lip portions 30*b* to 32*b*, and the vertical inner projections protruding from the lower surface of each of the inner-circumferential-wall lip portions 30*b* to 32*b*, or may have all of these projections.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. An elastic membrane for use in a substrate holding apparatus, comprising:

a contact portion to be brought into contact with a substrate for pressing the substrate against a polishing pad; and an edge circumferential wall extending from a peripheral edge of the contact portion, wherein the edge circumferential wall has an edge-circumferential-wall lip portion formed in an upper portion thereof, which is sandwiched between a head body of the substrate holding apparatus and an edge mounting member for securing the edge circumferential wall to the head body;

the edge-circumferential-wall lip portion includes a plurality of edge-circumferential-wall projections which are fitted into first recesses formed in the edge mounting member and/or second recesses formed in the head body; and the edge-circumferential-wall projections are arranged at equal intervals along a circumferential direction of the edge circumferential wall.

2. The elastic membrane according to claim 1, wherein the edge-circumferential-wall projections are vertical edge projections that protrude from an upper surface or a lower surface of the edge-circumferential-wall lip portion.

3. The elastic membrane according to claim 1, wherein the edge-circumferential-wall projections are lateral edge projections that protrude from a tip of the edge-circumferential-wall lip portion in a radial direction of the edge circumferential wall.

4. The elastic membrane according to claim 1, wherein some of the edge-circumferential-wall projections are vertical edge projections that protrude from an upper surface or a lower surface of the edge-circumferential-wall lip portion, and the rest of the edge-circumferential-wall projections are lateral edge projections that protrude from a tip of the edge-circumferential-wall lip portion in a radial direction of the edge circumferential wall.

5. The elastic membrane according to claim 1, further comprising at least one inner circumferential wall which is located radially inwardly of the edge circumferential wall and extends from the contact portion, wherein the inner circumferential wall has an inner-circumferential-wall lip portion formed at an upper portion thereof, which is sandwiched between the head body and an inner mounting member for securing the inner circumferential wall to the head body, the inner-circumferential-wall lip portion has a plurality of inner-circumferential-wall projections which are fitted into third recesses formed in the edge mounting member and/or fourth recesses formed in the head body, and the inner-circumferential-wall projections are arranged at equal intervals along a circumferential direction of the inner circumferential wall.

6. The elastic membrane according to claim 5, wherein the inner-circumferential-wall projections are vertical inner projections that protrude from an upper surface or a lower surface of the inner-circumferential-wall lip portion.

7. The elastic membrane according to claim 5, wherein the inner-circumferential-wall projections are lateral inner projections that protrude from a tip of the inner-circumferential-wall lip portion in a radial direction of the inner circumferential wall.

8. The elastic membrane according to claim 5, wherein some of the inner-circumferential-wall projections are vertical inner projections that protrude from an upper surface or a lower surface of the inner-circumferential-wall lip portion, and the rest of the inner-circumferential-wall projections are lateral inner projections that protrude from a tip of the inner-circumferential-wall lip portion in a radial direction of the inner circumferential wall.

9. A substrate holding apparatus, comprising:

an elastic membrane that forms at least one pressure chamber for pressing a substrate;

a head body to which the elastic membrane is secured; and at least one mounting member for securing the elastic membrane to the head body, wherein the elastic membrane comprises a contact portion to be brought into contact with a substrate for pressing the substrate against a polishing pad; and an edge circumferential wall extending from a peripheral edge of the contact portion, wherein the edge circumferential wall has an edge-circumferential-wall lip portion formed in an upper portion thereof, which is sandwiched between a head body of the substrate holding apparatus and an edge mounting member for securing the edge circumferential wall to the head body;

the edge-circumferential-wall lip portion includes a plurality of edge-circumferential-wall projections which are fitted into first recesses formed in the edge mounting member and/or second recesses formed in the head body;

the edge-circumferential-wall projections are arranged at equal intervals along a circumferential direction of the edge circumferential wall, and some of the edge-circumferential-wall projections are vertical edge projections that protrude from an upper surface or a lower surface of the edge-circumferential-wall lip portion.

* * * * *